US007536122B2

(12) United States Patent
Ohkawa et al.

(10) Patent No.: US 7,536,122 B2
(45) Date of Patent: May 19, 2009

(54) TONER SUPPLY DEVICE, IMAGE FORMING APPARATUS AND TONER SUPPLYING METHOD

(75) Inventors: Yasunobu Ohkawa, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 91 days.

(21) Appl. No.: 11/713,018

(22) Filed: Mar. 2, 2007

(65) Prior Publication Data

US 2007/0230974 A1 Oct. 4, 2007

(30) Foreign Application Priority Data

Mar. 28, 2006 (JP) ..... 2006-088096

(51) Int. Cl.
*G03G 15/08* (2006.01)

(52) U.S. Cl. ..... 399/27

(58) Field of Classification Search ..... 399/27, 399/258

See application file for complete search history.

(56) References Cited

U.S. PATENT DOCUMENTS 5,585,899 A * 12/1996 Palumbo et al. ..... 399/258 X
6,795,660 B2 * 9/2004 Yugeta et al. ..... 399/27
6,819,897 B2 * 11/2004 Kita ..... 399/258 X
6,999,689 B2 * 2/2006 Kinoshita et al. ..... 399/27

FOREIGN PATENT DOCUMENTS

JP 03-220577 9/1991

* cited by examiner

*Primary Examiner*—Sandra L Brase
(74) *Attorney, Agent, or Firm*—Nixon & Vanderhye P.C.

(57) ABSTRACT

A toner supply device which includes: a multiple number of toner bottles; and a toner supply assembly mounting mechanism having the toner bottles mounted thereon and feeding toner discharged from the toner bottles to a developing unit and is controlled so as to supply toner to the developing unit in accordance with the amount of toner consumed in the process of printing of the developing unit, further includes: micro switches which each detect the amount of toner left in the toner storing portion with toner filled therein; and a controller for controlling the operation of the toner supply device, which selects one of the toner bottles to be used for supply of toner to a toner feed device, based on the amounts of toner in the multiple toner bottles, which are detected by the micro switches.

27 Claims, 27 Drawing Sheets

TONER SUPPLY DEVICE, IMAGE FORMING APPARATUS AND TONER SUPPLYING METHOD

This Nonprovisional application claims priority under 35 U.S.C. §119(a) on Patent Application No. 2006-88096 filed in Japan on 28 Mar. 2006, the entire contents of which are hereby incorporated by reference.

BACKGROUND (1) Field

The disclosed technology relates to a toner supply device, image forming apparatus and toner supplying method, in particular relating to an image forming apparatus that performs image formation with toner as well as a toner supply device and toner supplying method for use in the image forming apparatus.

(2) Description of the Prior Art

Recently, there have been increased demands for image forming apparatuses capable of high-speed operations, and as the number of printing (per unit time) increases the speed of the paper to be conveyed has been also enhanced. For example, conventionally the processing ability of an image forming apparatus with not lower than 60 sheets per minute (A4 short-edge feed) was previously regarded as a high-speed machines, but nowadays, the situation has changed and the machines having a processing speed of 80 sheets per minute or greater should be regarded as high-speed ones, and further, machines having a speed of 100 sheets per minute are being developed.

Since a large amount of toner is consumed in such image forming apparatuses, most of the developing units use a technology for keeping the toner concentration in the developing hopper constant and avoiding indication of "toner empty" from occurring when a large volume of printing has been performed. That is, the developing unit includes a plurality of toner containers arranged, and the toner supplied from each toner container is not directly fed to the developing hopper but is once collected in a toner feed device that functions as a "relay box", then is fed into the developing hopper as the toner concentration therein becomes lower (see patent document 1: Japanese Patent Application Laid-open Hei 03-220577).

Even in such a toner supply arrangement where a plurality of toner containers are provided, it is necessary to avoid a lack of toner to be supplied to the developing unit. However, when, in the conventional toner supply system, one toner container is replaced, the operating time of the developing unit is limited by the amount of toner left in the toner container that is currently being used. Accordingly, the operating time is demanded to be long enough to afford plenty of time up to the replacement of the toner container.

However, in the conventional toner supplying method, when all the toner in the toner container being used was used up and hence so-called toner empty was detected, and if high-speed printing is being continuously implemented with another toner container, to be used second, which holds a lower amount of toner left therein, the time up to replacement of the toner container becomes short, so that there is the problem that the image forming apparatus becomes liable to stop due to a lack of toner supply.

SUMMARY

The embodiment(s) of the present invention have been devised in view of the above conventional problem, it is therefore an object of the embodiment(s) to provide a toner supply device, image forming apparatus and toner supplying method whereby it is possible to prevent the image forming apparatus from stopping its operation due to a lack of toner supply.

The toner supply device, image forming apparatus and toner supplying method for solving the above problem can be configured as follows. A toner supply device according to a first aspect comprises: a plurality of toner containers filled with toner; a toner feed device having the toner containers mounted therein and feeding toner discharged from the toner containers to a developing unit that functions as a relay box, wherein the toner supply device is controlled so as to supply toner to the developing unit in accordance with the amount of toner consumed in the developing unit for the process of printing; a remaining toner quantity detector for detecting the amount of toner left in a toner storing portion filled with toner in the toner container; and a controller for controlling the operation of the toner supply device, and is characterized in that the controller has the function of selecting and determining one of the toner containers so as to be used for supply of toner to the developing unit, in accordance with the amounts of toner left in the multiple toner containers, detected by the remaining toner quantity detector.

A toner supply device according to a second aspect is characterized in that, in addition to the configuration described in the above first aspect, the toner container to be determined is the one that has the least amount of toner remaining therein among the multiple toner containers.

A toner supply device according to a third aspect is characterized in that, in addition to the configuration described in the above first or second aspect, the toner container comprises: a partitioning member which separates the container interior into the toner storing portion and an empty space without toner therein; and a partitioning member moving device which moves the partitioning member in accordance with the amount of toner left in the toner storing portion so that the toner storing portion will have a suitable volume, and the remaining toner quantity detector detects the position of the partitioning member when the volume of the toner storing portion has been reduced to a predetermined volume or lower.

A toner supply device according to a fourth aspect is characterized in that, in addition to the configuration described in the above third aspect, the remaining toner quantity detector estimates the amount of remaining toner by moving the partitioning member in the empty space.

A toner supply device according to a fifth aspect is characterized in that, in addition to the configuration described in the above third aspect, the remaining toner quantity detector stops detection of the amount of remaining toner in response to increase in the driving load of the partitioning member moving device when the partitioning member has reached a predetermined position in the empty space.

A toner supply device according to a sixth aspect is characterized in that, in addition to the configuration described in the above fourth or fifth aspect, the remaining toner quantity detector estimates the amount of remaining toner, based on the time taken for the partitioning member to move in the empty space.

A toner supply device according to a seventh aspect is characterized in that, in addition to the configuration described in any one of the above first to sixth aspects, the toner container includes a toner information manager with toner information recorded therein, the toner information manager is able to perform bi-directional communications with the controller, and the amounts of toner remaining in the multiple toner containers, detected by the remaining toner quantity detector are stored in both the toner information manager and the controller.

Also, a toner supply device according to a eighth aspect is characterized in that, in addition to the configuration described in any one of the above first to seventh aspects, detection of the amount of remaining toner by the remaining toner quantity detector is performed when the toner supply device is switched from the deactivated state to the activated state.

A toner supply device according to a ninth aspect is characterized in that, in addition to the configuration described in any one of the above first to eighth aspects, detection of the amount of remaining toner by the remaining toner quantity detector is performed before a printing operation or immediately before a printing operation after issuance or a printing request by the developing unit is started.

An image forming apparatus according to a tenth aspect includes a toner supply device comprising: a plurality of toner containers filled with toner; and a toner feed device having the toner containers mounted therein and feeding toner discharged from the toner containers to a developing unit, wherein the toner supply device is controlled so as to supply toner to the developing unit in accordance with the amount of toner consumed in the developing unit for the process of printing, and is characterized in that a toner supply device having any one of the above first to ninth aspects is mounted as the aforementioned toner supply device.

A toner supplying method according to an eleventh aspect is a toner supplying method for use in an image forming apparatus which includes a toner supply device comprising: a plurality of toner containers filled with toner; a toner feed device having the toner containers mounted therein and feeding toner discharged from the toner containers to a developing unit, wherein the toner supply device is controlled so as to supply toner to the developing unit in accordance with the amount of toner consumed in the developing unit for the process of printing, and comprises the steps of: detecting the amount of toner left in a toner storing portion filled with toner in the toner container; and selecting and determining one of the toner containers so as to be used for supply of toner to the developing unit, in accordance with the detected amounts of toner left in the multiple toner containers.

A toner supplying method according to a twelfth aspect, in addition to the process described in the above eleventh aspect, further comprises the step of selecting and determining the one toner container that has the least amount of toner remaining therein among the multiple toner containers.

A toner supplying method according to an thirteenth aspect is characterized in that, in addition to the process described in the above eleventh or twelfth aspect, the toner container comprises: a partitioning member which separates the container interior into the toner storing portion and an empty space without toner therein; and a partitioning member moving device which moves the partitioning member in accordance with the amount of toner left in the toner storing portion so that the toner storing portion will have a suitable volume, and further comprises the step of detecting the position of the partitioning member when the volume of the toner storing portion has been reduced to a predetermined volume or lower.

A toner supplying method according to a fourteenth aspect is characterized in that, in addition to the process described in the above thirteenth aspect, the remaining toner quantity detecting step includes a step of moving the partitioning member in the empty space.

A toner supplying method according to a fifteenth aspect is characterized in that, in addition to the process described in the above thirteenth aspect, the remaining toner quantity detecting step includes a step of stopping detection of the amount of remaining toner in response to increase in the driving load of the partitioning member moving device when the partitioning member has reached a predetermined position (wall portion) of the empty space.

A toner supplying method according to a sixteenth aspect is characterized in that, in addition to the process described in the above fourteenth or fifteenth aspect, the remaining toner quantity detecting step includes a step of detecting the time taken for the partitioning member to move in the empty space.

A toner supplying method according to a seventeenth aspect, in addition to the process described in any one of the above eleventh to sixteenth aspects, further comprises the step of storing the detected amounts of toner remaining in the multiple toner containers, into a controller for controlling the operation of the toner supply device and a toner information manager with toner information recorded therein, provided for each toner container.

A toner supplying method according to an eighteenth aspect is characterized in that, in addition to the process described in any one of the above eleventh to seventeenth aspects, the remaining toner quantity detecting step is effected when the toner supply device is switched from the deactivated state to the activated state.

A toner supplying method according to a nineteenth aspect is characterized in that, in addition to the process described in any one of the above eleventh to eighteenth aspects, the remaining toner quantity detecting step is effected before a printing operation by the developing unit is started, or immediately before the start of a printing operation which is requested.

According to the first aspect, since, upon supplying toner to the developing unit, one of the multiple toner containers is selected in accordance with the amounts of toner remaining in these toner containers, it is possible to replace toner containers efficiently. As a result, it is possible to prevent failures of output images and cessation of the image forming apparatus due to a lack of toner supply.

In addition to the above common effect that is obtained from the first to nineteenth aspects of the invention, each aspect of the invention has the following effect.

Detailedly, according to the second aspect, in addition to the effect achieved by the first aspect, since the toner container with the least amount of toner left therein is selected to use first, if the first container has run out of toner and hence needs to be replaced it is possible to secure long enough time for replacement of the empty toner container since the toner container to be used second has a greater amount of toner left therein.

With this configuration, it is possible to prevent failures of output images and cessation of the image forming apparatus due to a lack of toner supply.

According to the third aspect, in addition to the effect achieved by the first or second aspect, it is possible to easily detect the empty state of the toner container when there is no toner left therein.

According to the fourth aspect, in addition to the effect achieved by the third aspect, it is possible to easily detect the amount of toner left in the toner container.

According to the fifth aspect, in addition to the effect achieved by the third aspect, it is possible to easily detect the empty state of the toner container when there is no toner left therein.

According to the sixth aspect, in addition to the effect achieved by the fourth or fifth aspect, it is possible to easily estimate the amount of remaining toner.

According to the seventh aspect, in addition to the effect achieved by any one of the first to sixth aspects, it is possible to easily grasp the amount of toner left in a toner container to be used even when the toner container is set into another toner supply device or when the toner supply device is set with another toner container.

According to the eighth aspect, in addition to the effect achieved by any one of the first to seventh aspects, it is possible to detect the amounts of toner left in the toner containers without fail every time the toner supply device is started. For example, it is possible to detect the amounts of remaining toner exactly if some toner containers have been replaced when the apparatus was not activated.

According to the ninth aspect, in addition to the effect achieved by any one of the first to eighth aspects, it is possible to detect the exact amounts of toner left in the toner containers.

According to the tenth aspect, since, upon supplying toner to the developing unit, one of the multiple toner containers is selected in accordance with the amounts of toner remaining in these toner containers, it is possible to replace toner containers efficiently. As a result, it is possible to prevent failures of output images and cessation of the image forming apparatus due to a lack of toner supply.

According to the eleventh aspect, since, upon supplying toner to the developing unit, one of the multiple toner containers is selected use in accordance with the amounts of toner remaining in these toner containers, it is possible to replace toner containers efficiently. As a result, it is possible to prevent failures of output images and cessation of the image forming apparatus due to a lack of toner supply.

According to the twelfth aspect, in addition to the effect achieved by the eleventh aspect, since the toner container with the least amount of toner left therein is selected to use first, if the first container has run out of toner and hence needs to be replaced it is possible to secure long enough time for replacement of the empty toner container since the toner container to be used second has a greater amount of toner left therein. With this configuration, it is possible to prevent failures of output images and cessation of the image forming apparatus due to a lack of toner supply.

According to the thirteenth aspect, in addition to the effect achieved by the eleventh or twelfth aspect, it is possible to easily detect the empty state of the toner container when there is no toner left therein.

According to the fourteenth aspect, in addition to the effect achieved by the thirteenth aspect, it is possible to easily detect the amount of toner left in the toner container.

According to the fifteenth aspect, in addition to the effect achieved by the thirteenth aspect, it is possible to easily detect the empty state of the toner container when there is no toner left therein.

According to the sixteenth aspect, in addition to the effect achieved by the fourteenth or fifteenth aspect, it is possible to easily estimate the amount of remaining toner.

According to the seventeenth aspect, in addition to the effect achieved by any one of the eleventh to sixteenth aspects, it is possible to easily grasp the amount of toner left in a toner container to be used even when the toner container is set into another toner supply device or when the toner supply device is set with another toner container.

According to the eighteenth aspect, in addition to the effect achieved by any one of the eleventh to seventeenth aspects, it is possible to detect the amounts of toner left in the toner containers without fail every time the toner supply device is started. For example, it is possible to detect the amounts of remaining toner exactly if some toner containers have been replaced when the apparatus was not activated.

According to the nineteenth aspect, in addition to the effect achieved by any one of the eleventh to eighteenth aspects, it is possible to detect the exact amounts of toner left in the toner containers.

DESCRIPTION OF THE PREFERRED EMBODIMENTS

The best mode for carrying out aspects of the present invention will be described with reference to the drawings.

Figure 1:
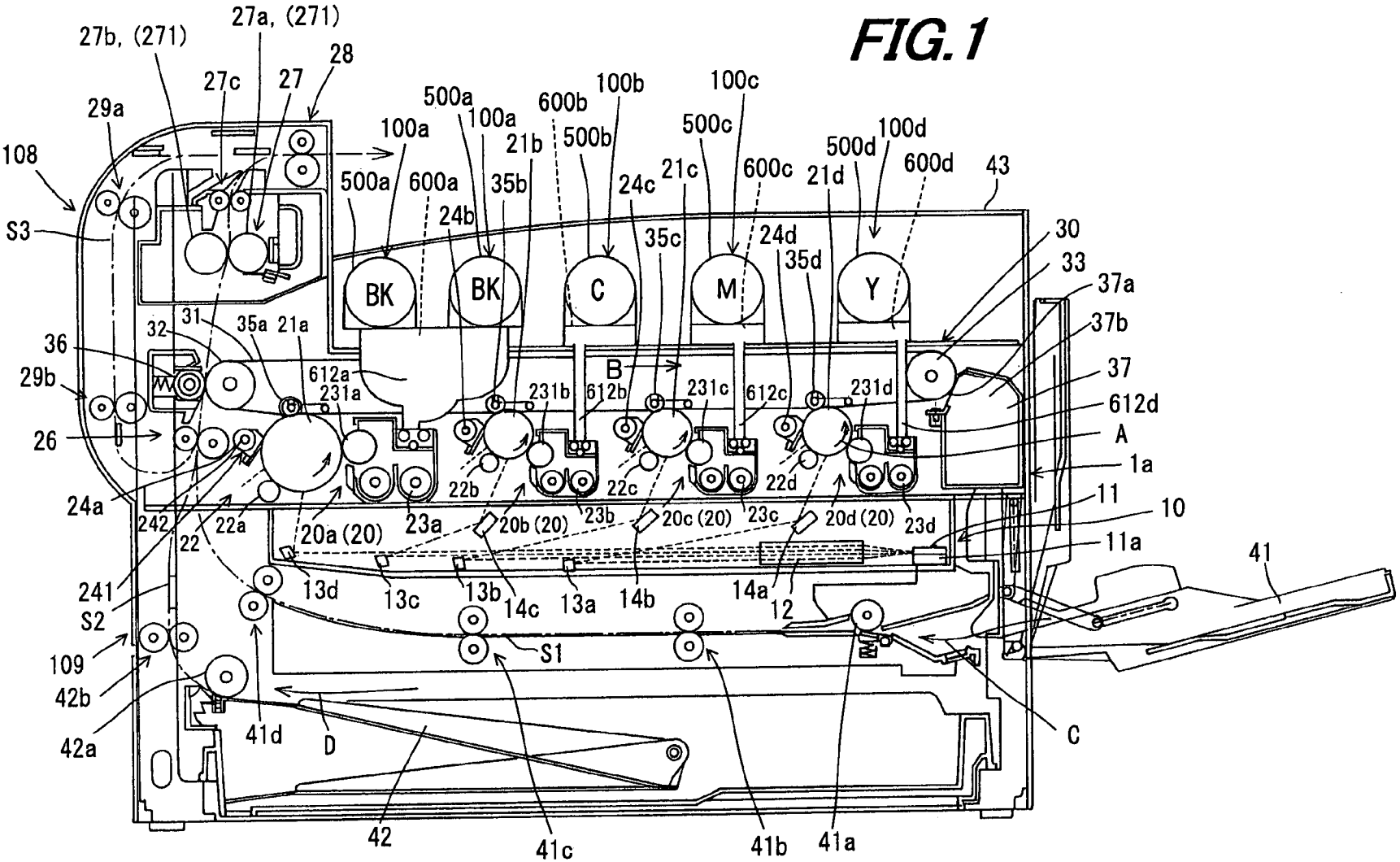
FIG. 1 is an illustrative view showing an overall configuration of an image forming apparatus using a toner container according to an embodiment of the present invention.

FIG. 1 is an example of the mode for carrying out an embodiment of the present invention, and is an illustrative view showing an overall configuration of an image forming apparatus using a toner container.

Figure 3:
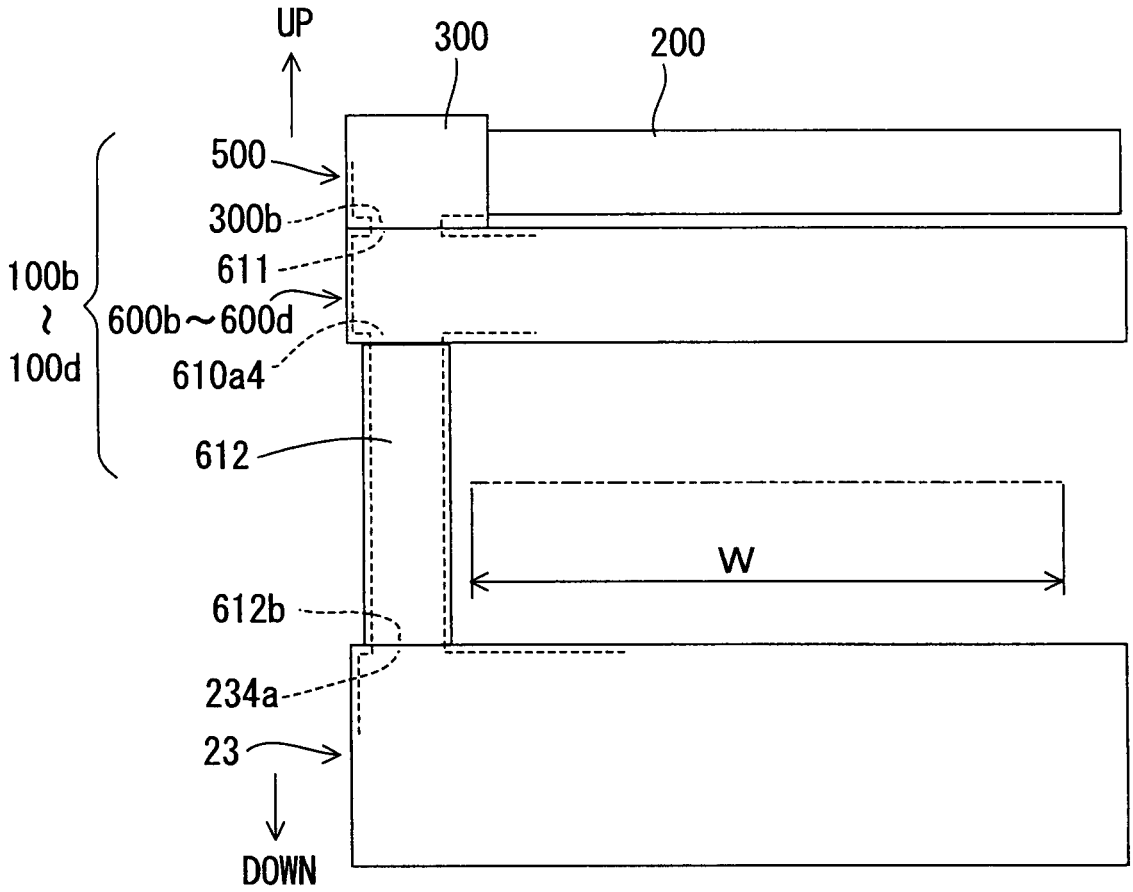
FIG. 3 is an overall front view showing the developing unit and toner supply device.
Figure 5:
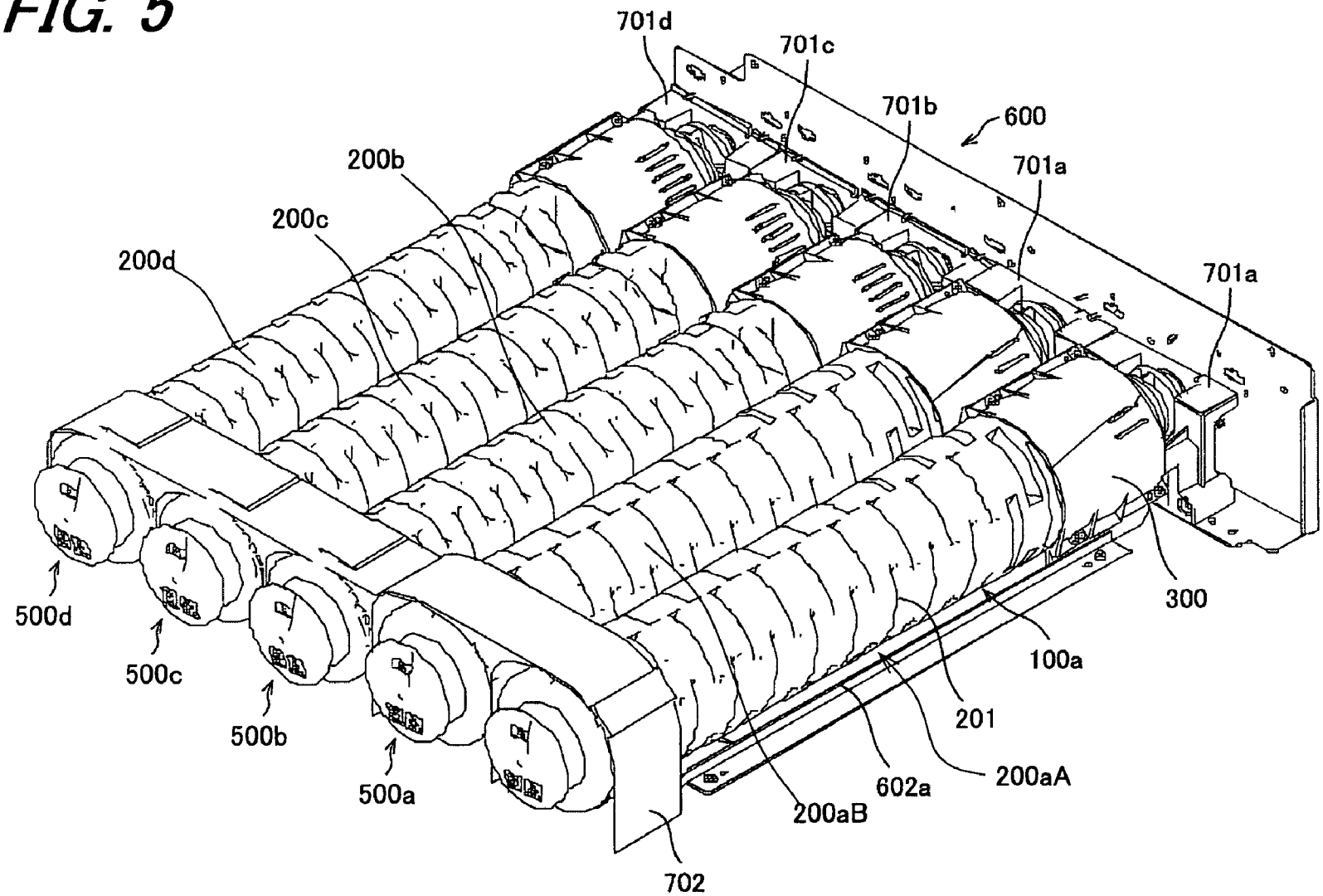
FIG. 5 is a perspective view showing a mounting example when toner supply assemblies are set in toner supply assembly mounting mechanisms that constitute the toner supply devices.
Figure 29:
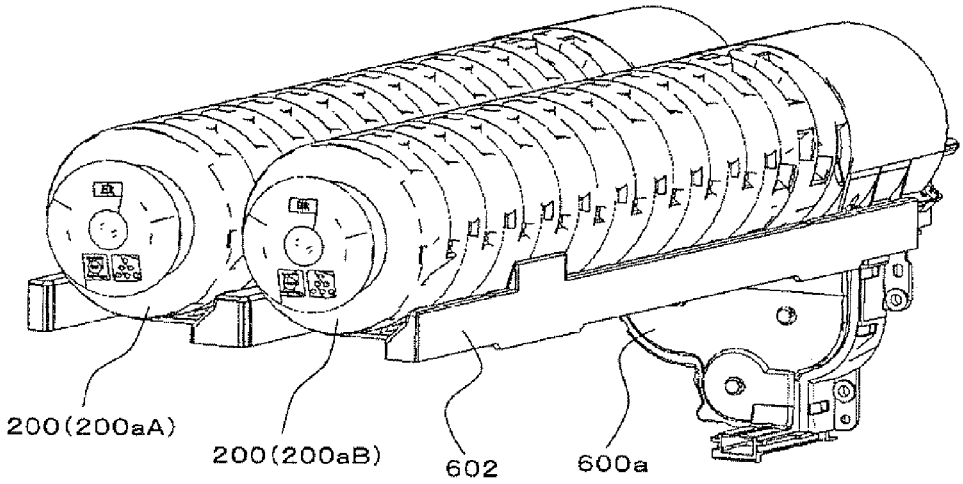
FIG. 29 is an illustrative view showing the arrangement of the toner bottles.

As shown in FIG. 1, the present embodiment is applied to an image forming apparatus 1 in which developer images formed on photoreceptor drums 21 (21*a*, 21*b*, 21*c* and 21*d*) with developers (toners) which a resupplied from developing rollers 231 (231*a*, 231*b*, 231*c* and 231*d*) in accordance with image data are transferred to a recording sheet by a transfer process, and includes toner supply devices 100 (100*a*, 100*b*, 100*c* and 100*d*), which include toner bottles (toner containers) 200 (200*a*A, 200*a*B, 200*b*, 200*c* or 200*d*: FIGS. 3, 5 and 29) for storing toner and toner supply assembly mounting mechanisms (toner feed devices) 600 (600*a*, 600*b*, 600*c* and 600*d*) that have toner bottles 200 mounted thereon and feed the toner discharged from the toner bottles 200 to associated developing units 23 (23*a*, 23*b*, 23*c* and 23*d*) in accordance with the amount of toner consumed at the printing process in developing units 23, to thereby perform image output by automatic toner supply to developing units 23.

As shown in FIG. 1, image forming apparatus according to the present embodiment includes: a plurality of process printing units (image forming means) 20 (20*a*, 20*b*, 20*c* and 20*d*) each having a photoreceptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 (23*a*, 23*b*, 23*c* or 23*d*) for supplying the toner to the photoreceptor drum 21 surface; an exposure unit (light scanning device) 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion is mainly composed of exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1, transfer belt unit 30 is extended under the fixing unit 27 from one end side to the other end side of housing 1*a*, process printing units 20 are disposed under the transfer belt unit 30, and exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), cyan (C), magenta (M) and yellow (Y) are arranged sequentially along transfer belt 31.

These process printing units 20(20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging means) 22 (22*a*, 22*b*, 22*c* and 22*d*) for charging the photoreceptor drums 21, respective developing units (developing means) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), cyan (C), magenta (M) and yellow (Y), respectively. In the description hereinbelow, however, the constituents provided for each color are generally referred to as photoreceptor drum 21, charger 22, developing unit 23, and cleaner unit 24, except in the case where the constituents corresponding to a specific color need to be specified and described.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Developing units 23*a*, 23*b*, 23*c* and 23*d* hold associated toners of black (BK), cyan (C), magenta (M) and yellow (Y) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to deal with high-speed and large-volume printing, toner supply devices 100*a*, 100*b*, 100*c* and 100*d* equipped with five toner supply assemblies 500*a*, 500*b*, 500*c* and 500*d* for supplying developers to respective developing units 23*a*, 23*b*, 23*c* and 23*d* are provided. Developing rollers 231*a*, 231*b*, 231*c* and 231*d* are arranged opposing respective photoreceptor drums 21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively to visualize them.

As the toner to be supplied, toners of black (BK), cyan (C), magenta (M) and yellow (Y) colors are stored in toner supply assemblies 500*a*, 500*b*, 500*c* and 500*d*, respectively.

Here, two toner supply assemblies 500*a* for black (BK) toner are arranged side by side in order to support large-volume printing, taking into account the practice that monochrome printing is usually used most frequently.

Each toner supply assembly 500 is arranged at a position approximately directly above the developing unit 23 for performing development with the corresponding toner, and is connected to the corresponding developing unit 23 by means of a toner supply passage part 612 (612*a*, 612*b*, 612*c* or 612*d*).

Here, supply passage part 612*a* and toner supply assembly mounting mechanism 600*a* for supplying the black (BK) toner is constructed so that the toner from two toner supply devices 100*a* and 100*a* can be put together and supplied to developing unit 23*a*.

Cleaner unit 24 is arranged on the upstream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor drum 21 so as to scrape and collect the leftover toner off the photoreceptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 is mainly composed of a box-shaped housing 10*a*, a laser scanning unit (LSU) 11 having a laser illuminator 11*a* incorporated therein, a polygon mirror 12 and reflection mirrors 13*a*, 13*b*, 13*c*, 13*d*, 14*a*, 14*b* and 14*c* etc. for reflecting the laser beams for associated colors.

The laser beam emitted from the laser illuminator of laser scanning unit 11 is separated into color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 may be displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33, however it may be so configured as to be positioned with their axes displaced relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 disposed at its contact point with transfer belt 31.

Transfer roller 36 as a constituent of the transfer means is a component for transferring the developer image transferred to transfer belt 31 to recording paper, and is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet that is fed from paper feed portion 109 toward the transfer roller 36 side by aligning the front end of the sheet with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause color contamination of toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the leftover toner, remained on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output upward towards conveying roller 27*c*.

Above fixing unit 27 a paper discharge roller 28 is arranged so that the recording sheet conveyed from conveying roller 27*c* is discharged by the paper discharge roller 28 onto paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward to the vicinity of paper feed portion 109. Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located, below conveying roller 29*a* with respect to the top and bottom direction, and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller as a means for applying pressure. That is, any appropriate method can be used as long as it can uniformly fix the toner image to the recording paper with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers paper, sheet by sheet, into the housing 1*a* of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow C in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s feed direction of recording paper.

Pickup roller 42*a* touches one edge part of the surface of the topmost sheet of the recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage. Each electrified photoreceptor drum 21 is irradiated with a laser beam from exposure unit 10, so that an electrostatic latent image for each color is formed on the photoreceptor drum 21 for the color.

Next, toner is supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with toner so as to form toner images.

Then, the toner image formed on photoreceptor drum 21 is transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause color contamination of toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108 located above.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with the toner image transferred thereon is conveyed approximately vertically and reaches fixing unit 27, where the toner image is thermally fixed to the recording sheet by heat roller 27*a* and pressing roller 27*b*.

When one-sided printing is requested, the recording sheet having passed through fixing unit 27 is discharged by discharge roller 28 and placed facedown on paper output tray 43.

In contrast, when double-sided printing is requested, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged onto paper output tray 43 by paper discharge roller 28.

Thus, the transfer operation to recording paper is performed.

Next, the configuration of developing unit 23 and toner supply device 100 according to the present embodiment will be described in detail with reference to the drawings.

Figure 2:
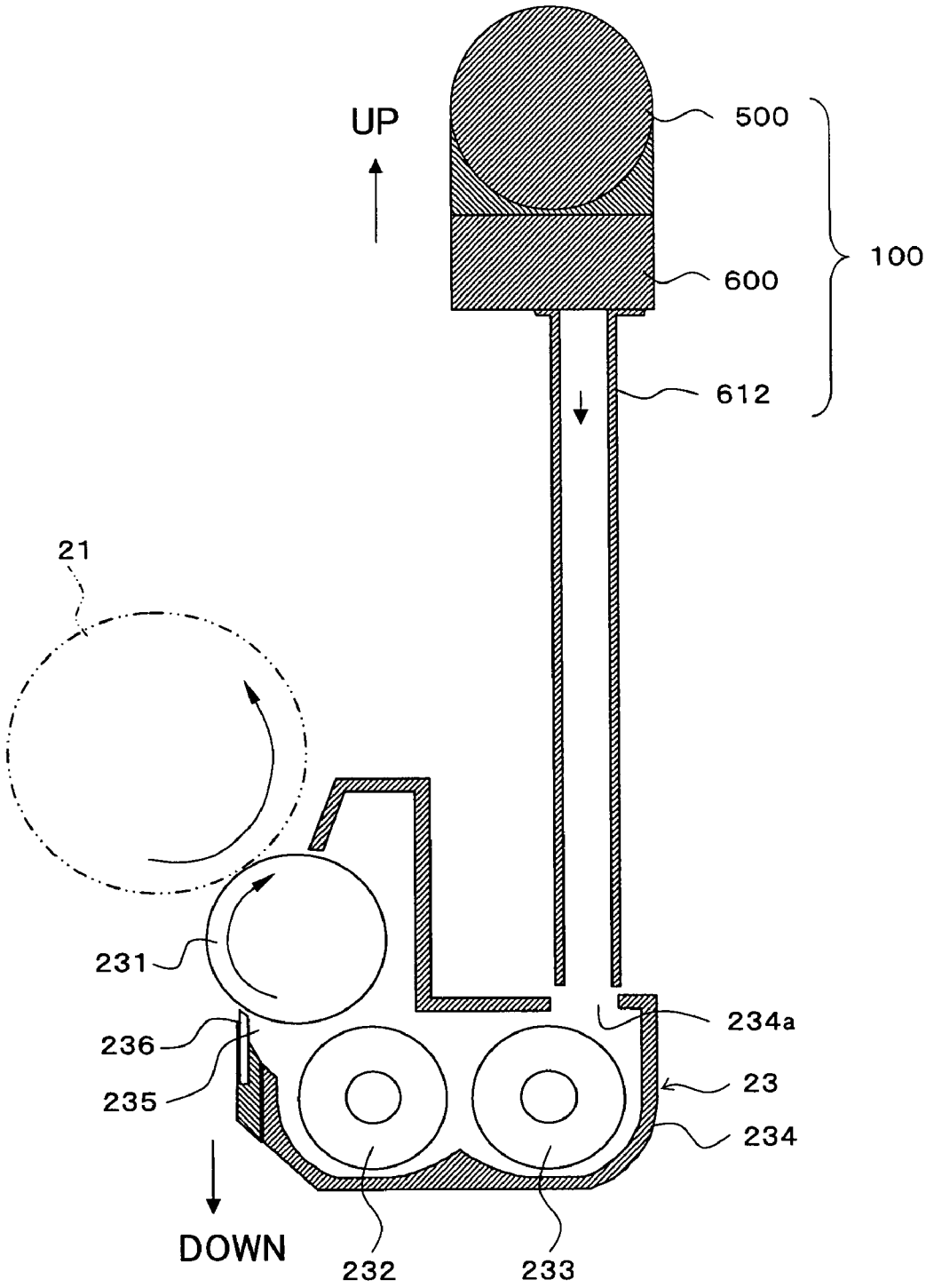
FIG. 2 is a schematic side sectional view showing a configuration of a developing unit and a toner supply device that constitute the image forming apparatus.
Figure 4:
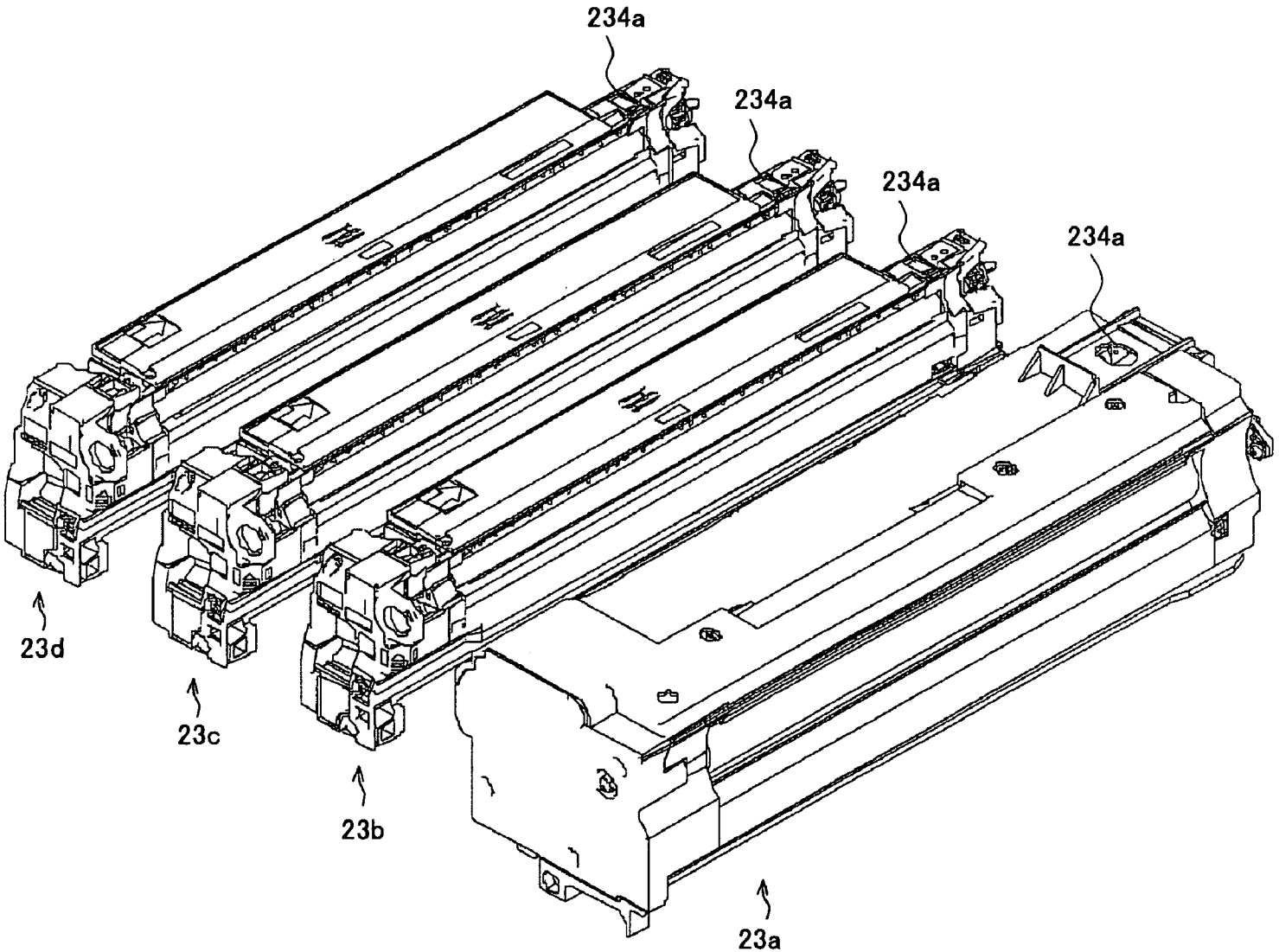
FIG. 4 is a perspective view showing the configuration of the developing unit.
Figure 6:
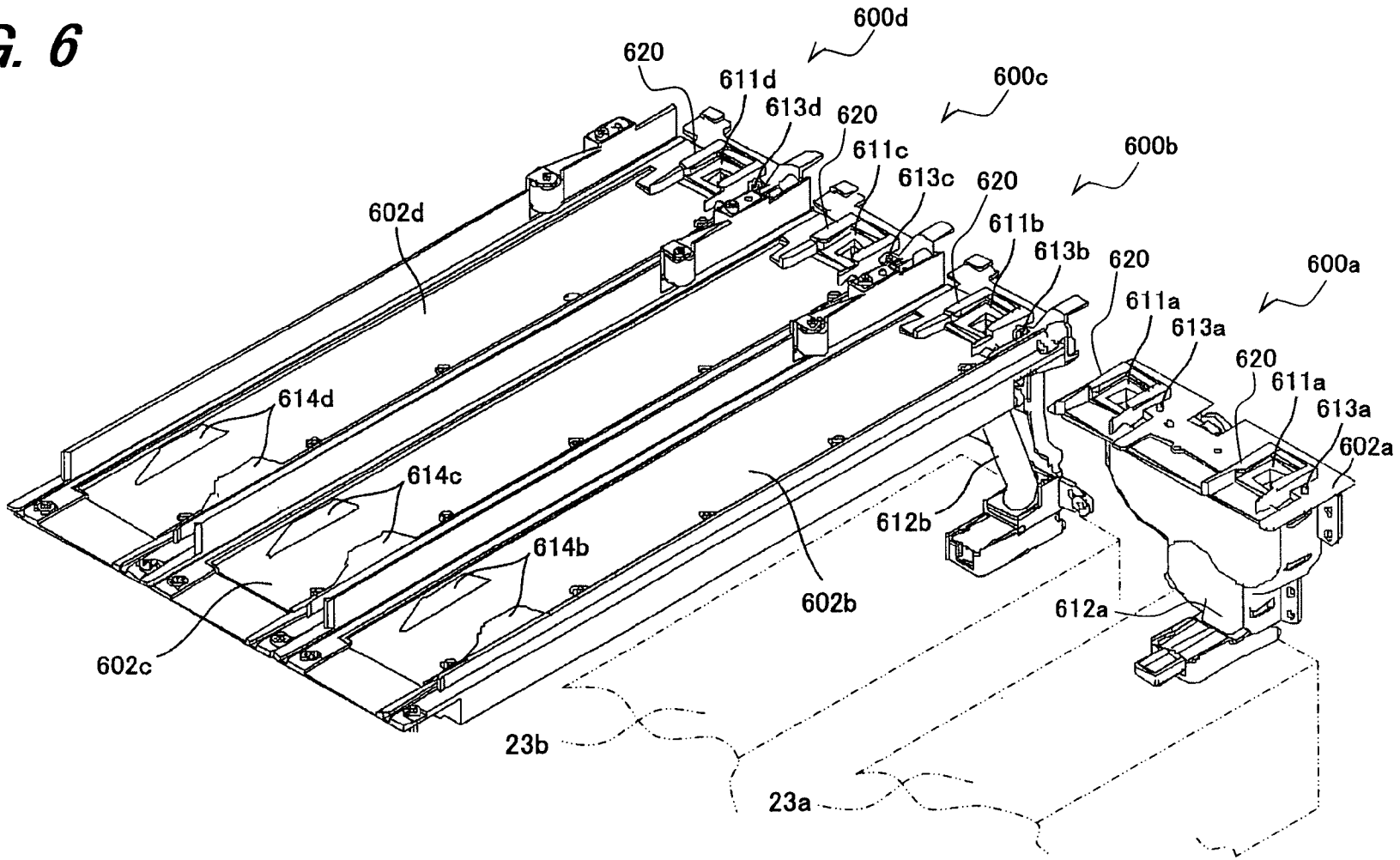
FIG. 6 is a perspective view showing the configuration of the toner supply assembly mounting mechanisms.

FIG. 2 is a schematic side sectional view showing a configuration of a developing unit and a toner supply device that constitute an image forming apparatus of the present embodiment; FIG. 3 is an overall front view showing the configuration of the developing unit and toner supply device; FIG. 4 is a perspective view showing the configuration of the developing unit mounted to the image forming apparatus according to the present embodiment; FIG. 5 is a perspective view showing a mounting example when toner supply assemblies are set in a toner supply assembly mounting mechanisms that constitute the toner supply devices according to the present embodiment; and FIG. 6 is a perspective view showing a configuration of the toner supply assembly mounting mechanisms.

To begin with, developing unit 23 will be described.

As shown in FIGS. 2 and 3, in developing unit 23, a toner input port 234*a* for leading the toner is formed as an opening at the top of a casing 234 that forms its exterior. The developing unit incorporates inside casing 234 a developing roller 231, a first toner conveying roller 232 and a second toner conveying roller 233, and is mounted to the image forming apparatus body with the developing roller 231 opposed, in abutment with, or close to, photoreceptor drum 21. This toner input port 234*a* of developing unit 23 is formed at a position further outside of the width W of the transfer belt, on the same side as a toner feed port 611 (611*a*, 611*b*, 611*c* or 611*d*) of a toner supply assembly mounting mechanism 600 (600*a*, 600*b*, 600*c* or 600*d*) is disposed.

First toner conveying roller 232 and second toner conveying roller 233 are disposed in the bottom of casing 234 in parallel with each other along the axis direction of developing roller 231 so that the toner that is fed into casing 234 is agitated with the developer and conveyed to developing roller 231. Developing roller 231 is arranged over and above first toner conveying roller 232 so as to be exposed from an opening mouth 235.

Casing 234 is a box-shaped configuration elongated in the direction (the width direction of the transfer belt) perpendicular to the direction of transfer (the transfer belt's direction of movement) when mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing roller 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through this clearance.

Arranged over the thus constructed developing unit 23 is toner supply device 100 (FIGS. 2 and 3).

Referring next to the drawings, the configuration of toner bottle 200 and toner supply device 100 according to the present embodiment will be described.

Figure 7A:
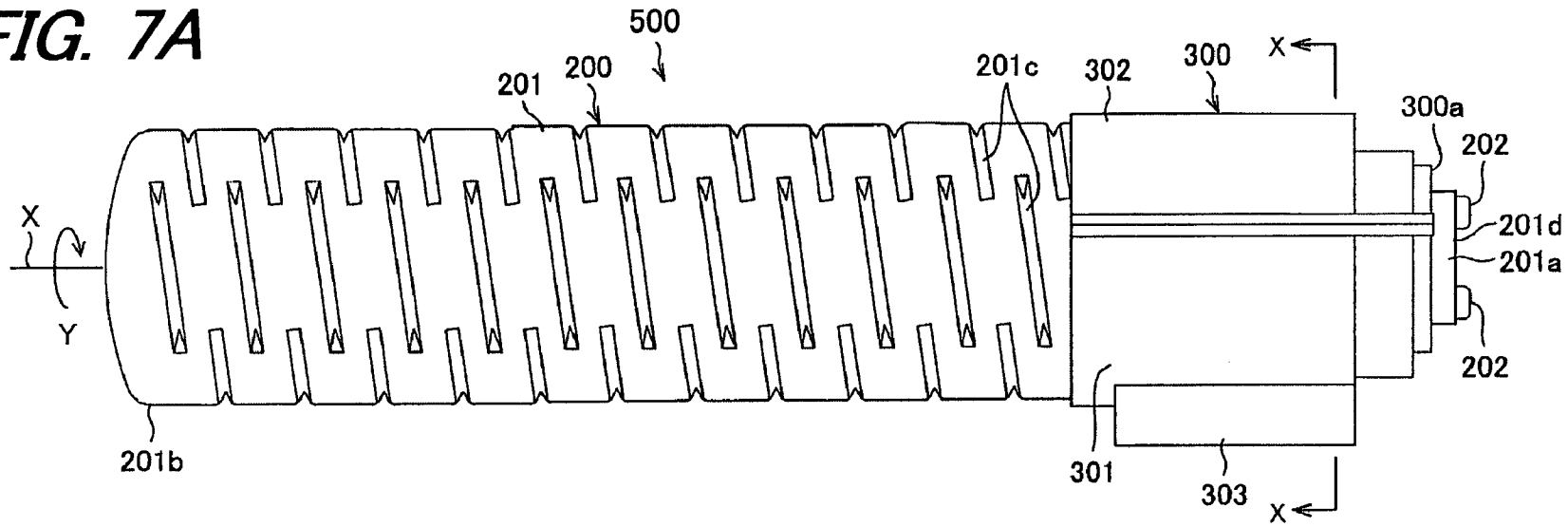
FIG. 7A is a side view showing a configuration of a toner supply assembly as a part of the toner supply device and FIG. 7B is its front view, viewed from the end face side of the toner supply assembly from which toner is supplied.
Figure 7B:
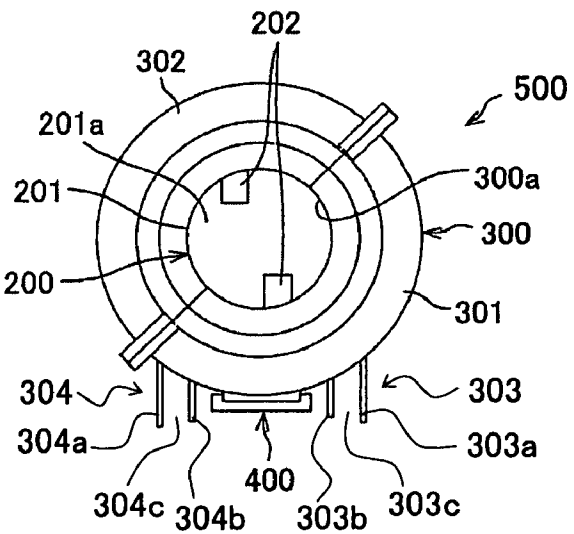
Figure 8:
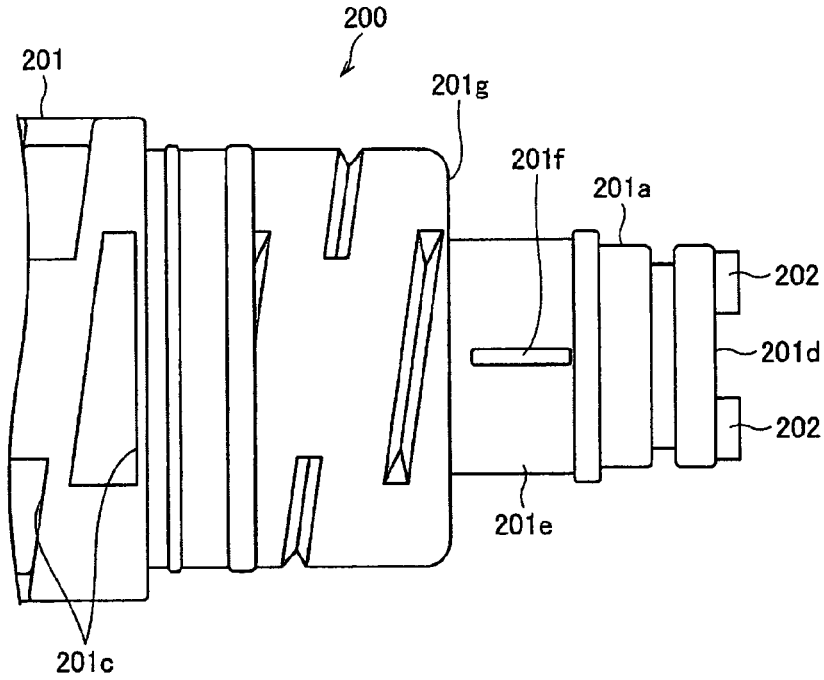
FIG. 8 is a side view of the front end part of a toner bottle as a part of the toner supply assembly.
Figure 9:
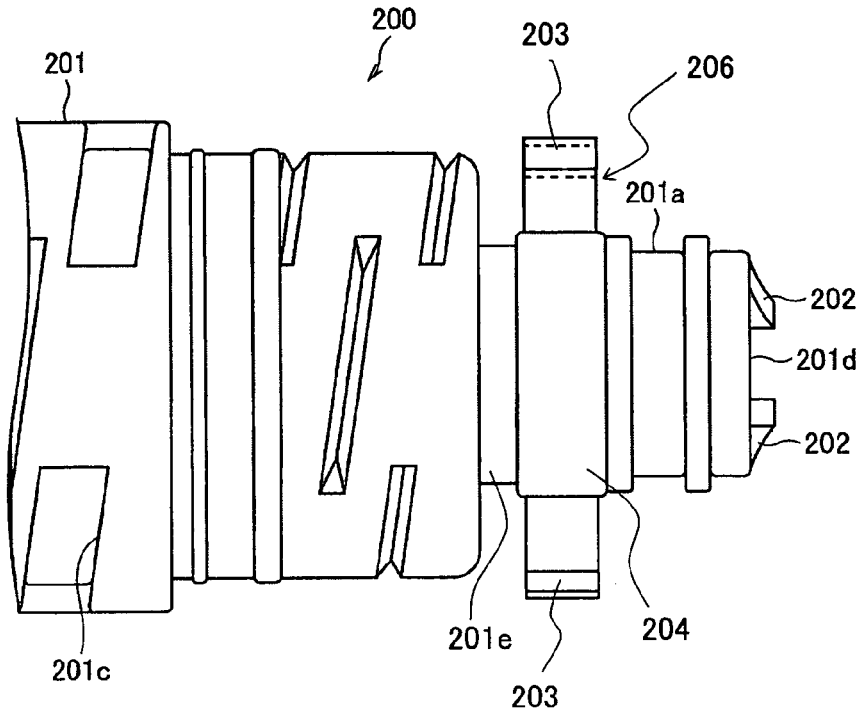
FIG. 9 is a side view showing a configuration when scrapers for toner conveyance are fitted to the front end part of the toner bottle.
Figure 10:
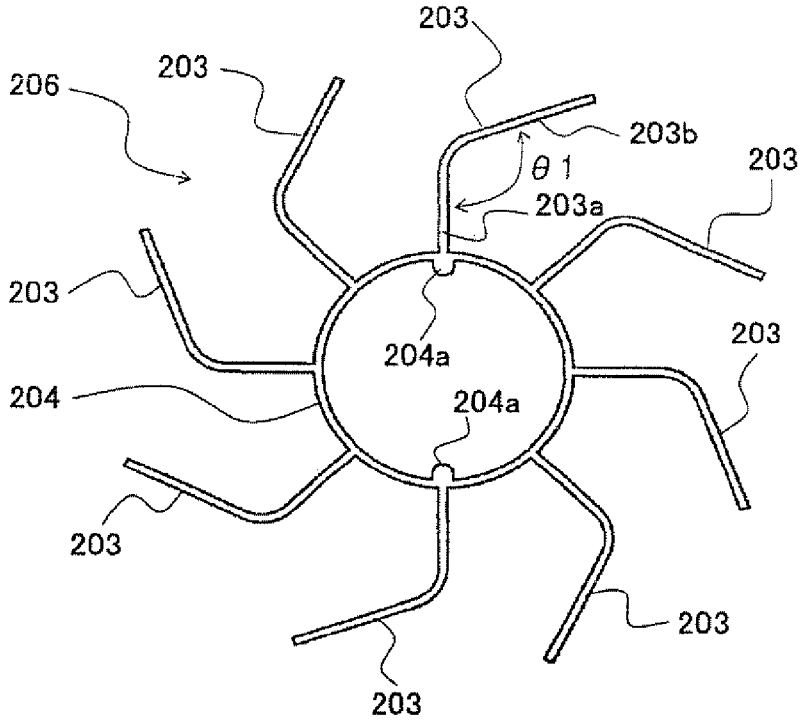
FIG. 10 is an illustrative view showing one example of the scrapers.
Figure 11:
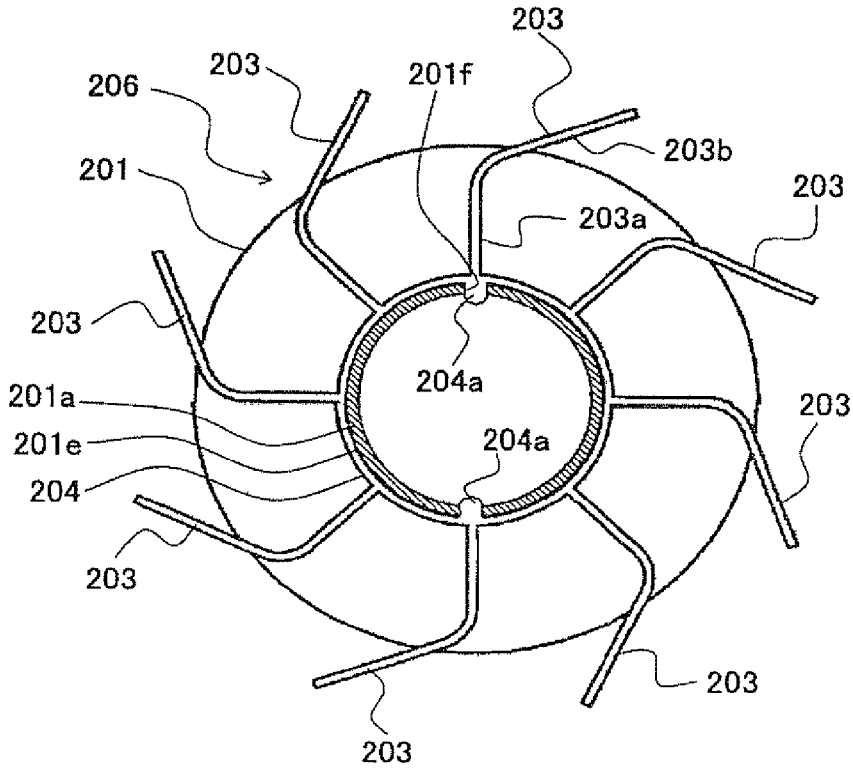
FIG. 11 is an illustrative view schematically showing a case where the scrapers are attached to the toner bottle.
Figure 12:
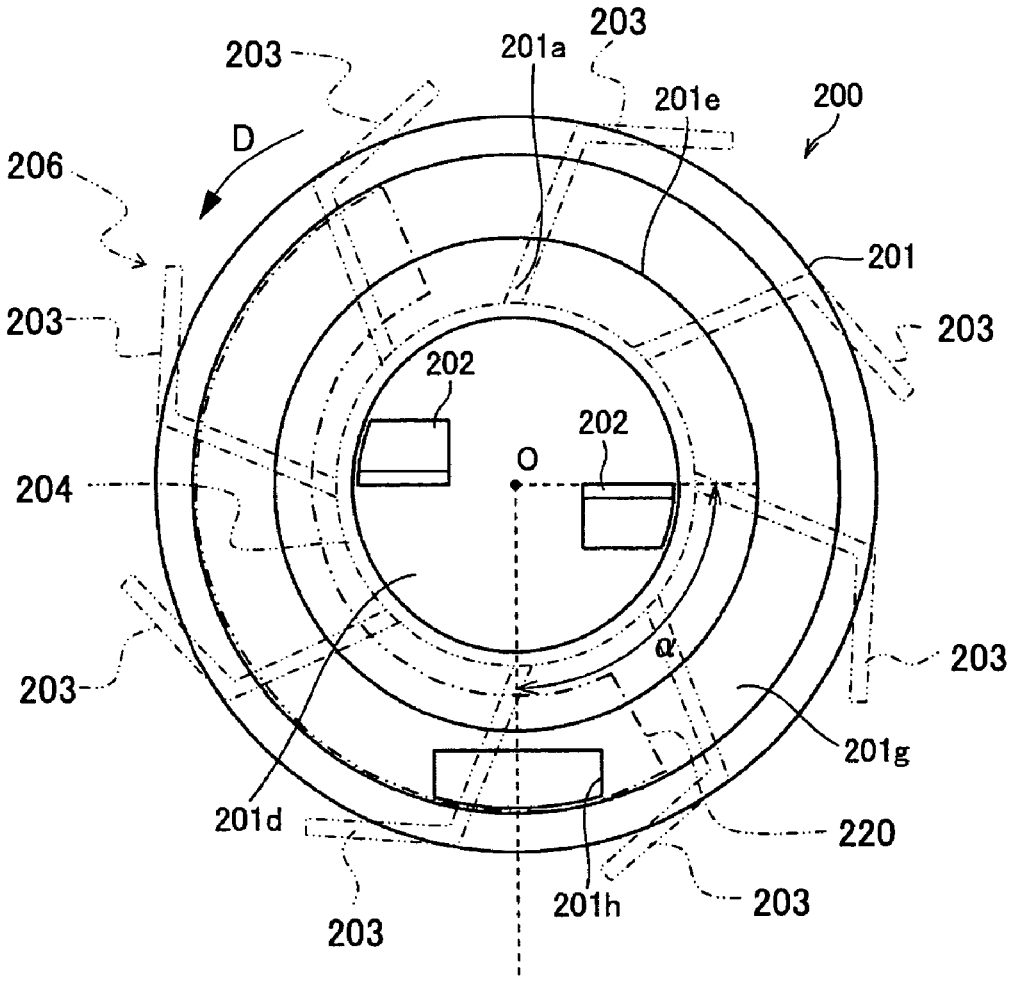
FIG. 12 is a front view showing a configuration of the toner bottle.

FIG. 7A is a side view showing a configuration of a toner supply assembly as a part of the toner supply device according to the present embodiment; FIG. 7B is a front view of the toner supply assembly, viewed from the end face side from which toner is supplied; FIG. 8 is a side view of the front end part of a toner bottle as a part of the toner supply assembly; FIG. 9 is a side view showing a configuration when scrapers for toner conveyance are fitted to the front end part of the toner bottle; FIG. 10 is an illustrative view showing one example of the scrapers; FIG. 11 is an illustrative view schematically showing a case where the scrapers shown in FIG. 10 are fitted to the toner bottle; and FIG. 12 is a front view showing a configuration of the toner bottle.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIGS. 2 and 7A, toner supply device 100 is mainly composed of a toner bottle (toner container) 200 that is filled with toner as a developer, a toner supply assembly 500 having a bottle holder (toner container holder) 300 that rotatably holds the toner bottle 200 at its one end, and a toner supply assembly mounting mechanism (toner feed device) 600 to which the toner supply assembly 500 is mounted so as to feed toner to developing unit 23.

Provided on the bottom of bottle holder 300 (the lower side when toner supply device 100 is mounted in image forming apparatus 1) is a shutter mechanism 400 for opening and closing an after mentioned toner discharge port for discharging the toner fed from toner bottle 200 to the outside of bottle holder 300, as shown in FIG. 7B.

Illustratively, when the toner discharge port of bottle holder 300 is opened by shutter mechanism 400, the toner discharge port and supply passage part 612 as a part of toner supply assembly mounting mechanism 600 are connected to each other so that the toner supplied from toner bottle 200 is fed to developing unit 23 by way of supply passage part 612 that is connected to developing unit 23.

To begin with, toner bottle 200 which is the characteristic part in the present embodiment will be described.

As shown in FIG. 7A, toner bottle 200 is comprised of a main part 201 having an approximately cylindrical shape. When the end of main part 201 on the side supported by bottle holder 300 is called a front end part 201*a*, this front end part 201*a* is formed with an opening (described later) for discharging toner. The other end of main part 201 on the opposite side from front end part 201*a*, namely, rear end 201*b* is closed.

Formed on the peripheral side of main part 201 is a plurality of slots 201*c* which is depressed towards the rotational axis X. Here, on the interior side of main part 201, the parts corresponding to slots 201*c* form ribs that are projected towards the rotational axis X side.

The grooves formed between these ribs function as guide grooves for guiding the toner stored in main part 201 from rear end part 201*b* toward front end part 201*a*.

Herein, slots 201*c* are spirally formed as shown in FIG. 7A or inclined in such a manner that lower side in gravitational direction is inclined toward front end portion 201*a* while upper side in anti-gravitational direction is inclined toward rear end part 201*b* so that they move toward front end part 201*a* when main part 201 rotates about the rotational axis X clockwise viewed from the front end side (in the Y-direction). With this configuration, as toner bottle 200 rotates in the Y-direction, the toner held in the toner bottle 200 can be conveyed from rear end part 201*b* to front end part 201*a* of main part 201.

Here, slots 201*c* may have any shape as long as they can convey the toner stored in main part 201 from rear end part 201*b* toward front end part 201*a*.

As shown in FIG. 8, front end part 201*a* is formed to be a cylindrical shape having a smaller diameter than that of the central part of main part 201. A pair of ribs 202, 202 is projected outward from the front end face 201*d* of front end part 201*a*.

These ribs 202, 202 are adapted to be engaged with an actuator of an unillustrated drive when toner supply device 100 is mounted to image forming apparatus 1. With this arrangement, a drive force from the actuator is transferred by way of ribs 202 and 202 to toner bottle 200 of toner supply device 100 so that it is rotated.

As shown in FIGS. 9 and 10, peripheral surface 201*e* of front part end 201*a* is formed with a toner conveying means 206 which is constructed of a plurality of scrapers (toner conveyors) 203 for conveying toner and a fixing member (toner conveyor attachment) 204 on which scrapers 203 are integrally fixed.

Scrapers 203 are each formed of a plate-like elastic resin such as rubber etc, and arranged approximately radially outwards and equi-angularly at eight positions on the peripheral surface of fixing member 204, as shown in FIGS. 10 to 12.

Each scraper 203 is formed in an inverted, approximately open-V section with its free end side bent to the upstream side (to the rear) with respect to the rotational direction (the direction indicated by arrow D in FIG. 12) of toner bottle 200.

In the present embodiment, the part of scraper 203, extending radially from fixing member 204 functions as a toner conveying portion 203*a* and the part that is flexed to the upstream side (rear side) with respect to the rotational direction of toner bottle 200 functions as a lid portion 203*b*.

Figure 13A:
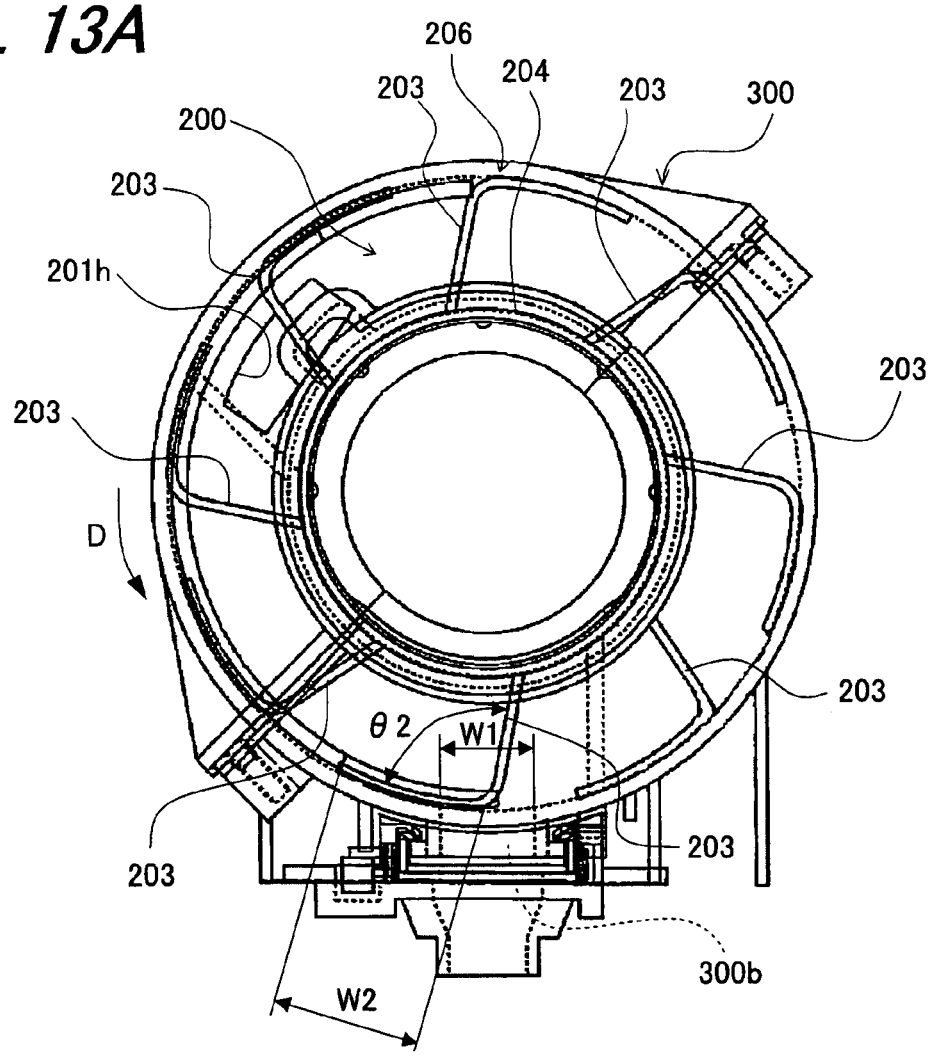
FIG. 13A is a front view showing a configuration of a bottle holder that constitutes the toner supply device.
Figure 13B:
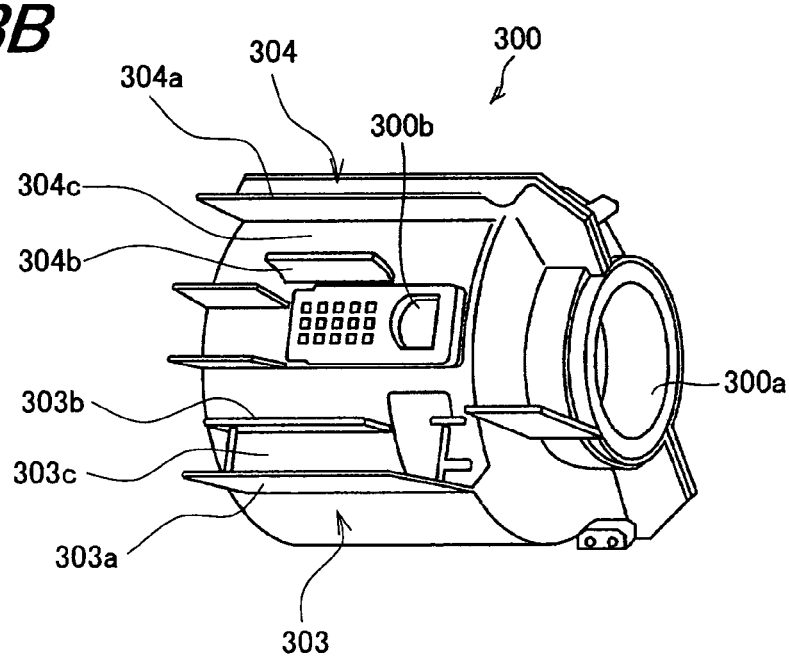
FIG. 13B is a perspective view showing the bottle holder, when it is viewed from the rear side.

Toner conveying portion 203*a* is formed longer than the size of the toner conveyance space in bottle holder 300, so that, when toner conveying means 206 fitted on toner bottle 200 is assembled inside bottle holder 300 and the toner bottle 200 is rotated the free end side of the scraper is tilted to the upstream side (rearwards) with respect to the toner bottle's direction of rotation (see FIGS. 13A and 13B).

This arrangement is aimed at scraping out the toner that is accumulated in toner discharge chamber 300*d* (FIG. 15) efficiently. However, if the length of toner conveying portion 203*a* of scraper 203 is too long, its friction with the inner peripheral surface of bottle holder 300 becomes greater, causing increase in rotational load. Accordingly, it is preferred that the length of the toner conveying portion is set at a size that will not cause sharp increase of the rotational load.

Lid portion 203*b* is formed so that the length W2 that comes into sliding contact with the inner peripheral surface of bottle holder 300 is longer than the opening length W1 of toner discharge port 300*b*. That is, lid portion 203*b* is constructed so as to completely cover the opening of toner discharge port 300*b* when it opposes toner discharge port 300*b* (see FIGS. 13A and 13B).

The opening angle between toner conveying portion 203*a* and lid portion 203*b* is set so that $\theta 1 > \theta 2$, where $\theta 1$ is the angle when scraper 203 shown in FIG. 10 is set free and $\theta 2$ is the angle when scraper 203 is assembled inside bottle holder 300 (FIG. 13A). The difference in opening angle makes it possible to bring lid portion 203*b* into close contact with toner discharge port 300*b* by the resilient force of scraper 203.

As shown in FIG. 10, fixing member 204 has an annular shape, made up of a material having elasticity (a general elastic resin such as rubber etc.), having an inside diameter marginally smaller than the outside diameter of front end part 201*a* (FIG. 9) and being formed with projections 204*a* (FIG. 10) on the inner peripheral surface thereof.

These projections 204*a* are adapted to fit into cutouts 201*f* that are previously formed on the front end part 201*a*, as shown in FIG. 11.

In the present embodiment, use of this fixing member 204 makes it simple to arrange scrapers 203 on main part 201 by enlarging the ring part slightly and setting it on peripheral surface 201*e* (FIG. 8) of front end part 201*a*. Moreover, it is possible to reliably fix fixing member 204 to front end part 201*a* by fitting protections 204*a* of fixing member 204 into cutouts 201*f* formed on peripheral surface 201*e* of front end part 201*a*. That is, this arrangement enables fixing member 204 to be driven integrally with front end part 201*a* without it running idly over peripheral surface 201*e* of front end part 201*a*.

Here, scrapers 203 may be directly provided on peripheral surface 201*e* of front end part 201*a*.

Formed on an end face 201*g* that forms a step with front end part 201*a* in main part 201 is a bottle-side toner discharge port 201*h* for discharging the toner held in main part 201, as shown in FIG. 12.

Here, in the present embodiment, this bottle-side toner discharge port 201*h* is formed in an essentially rectangular shape, but the opening of the discharge port should not be limited to this and may have an approximately square-shaped, polygonal, circular or any other shaped configuration as long as it will not hinder discharge of toner.

Further, as shown in FIG. 12, scraper 203 is adjusted and positioned so that its center position forms a predetermined angle $\alpha$ with the center of bottle-side toner discharge port 201*h* when fixing member 204 is attached to the bottle.

Here, scrapers 203 are preferably disposed at positions so as not to disturb toner discharge from bottle-side toner discharge port 201*h*. As long as this condition is satisfied, any angle can be selected as angle $\alpha$. In order to reliably prevent failures of toner discharge from bottle-side toner discharge port 201*h*, angle $\alpha$ is preferably set at 90 degrees.

The toner discharged from bottle-side toner discharge port 201*h* is collected inside bottle holder 300 that is provided so as to cover front end part 201*a*. Bottle holder 300 is formed with a toner discharge port (which will be described later) for discharging the collected toner.

As shown in FIG. 12, bottle-side toner discharge port 201*h* is temporarily closed by a sealing element 220 directly before the operation of supplying toner to developing unit 23 is started as toner bottle 200 rotates.

Sealing element 220 is formed of a flexible material in an arc shape and is configured so that it peels off toner bottle 200 by rotation of the toner bottle 200 to thereby release bottle-side toner discharge port 201*h*.

Next, bottle holder 300 will be described in detail with reference to the drawings.

Figure 14A:
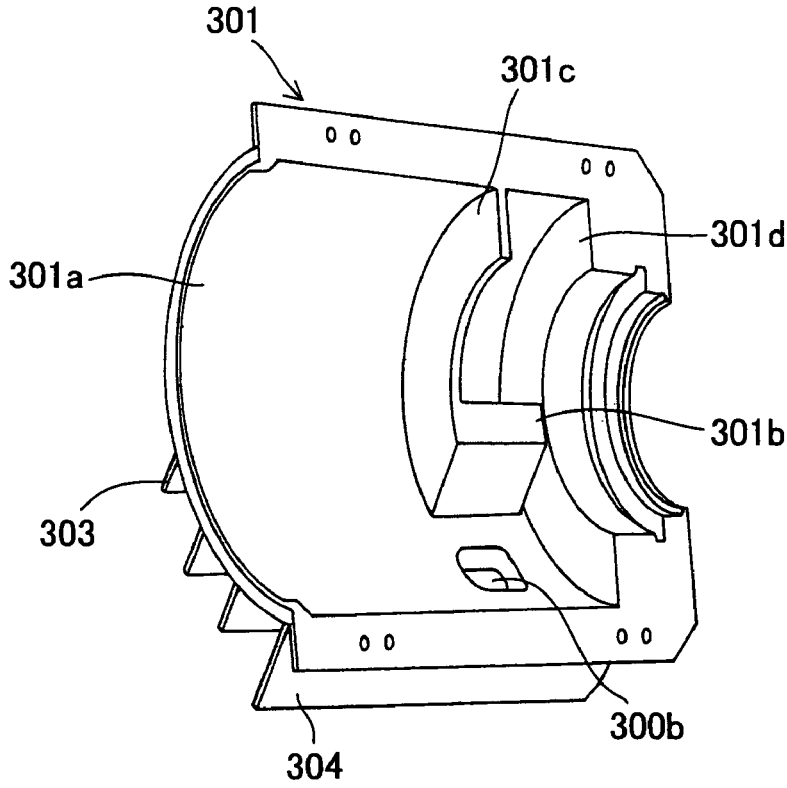
FIG. 14A is a perspective view showing a first casing that constitutes the bottle holder.
Figure 14B:
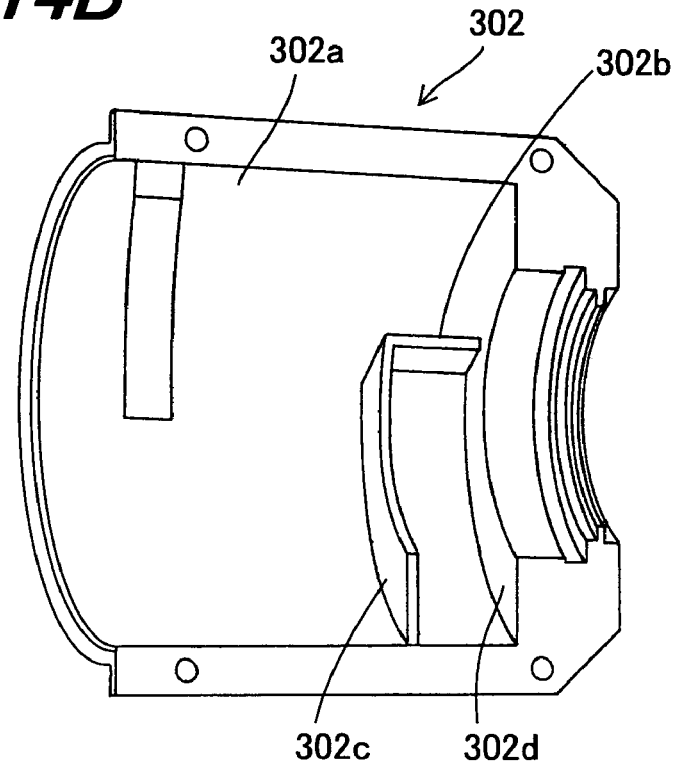
FIG. 14B is a perspective view showing a second casing that constitutes the bottle holder.
Figure 15:
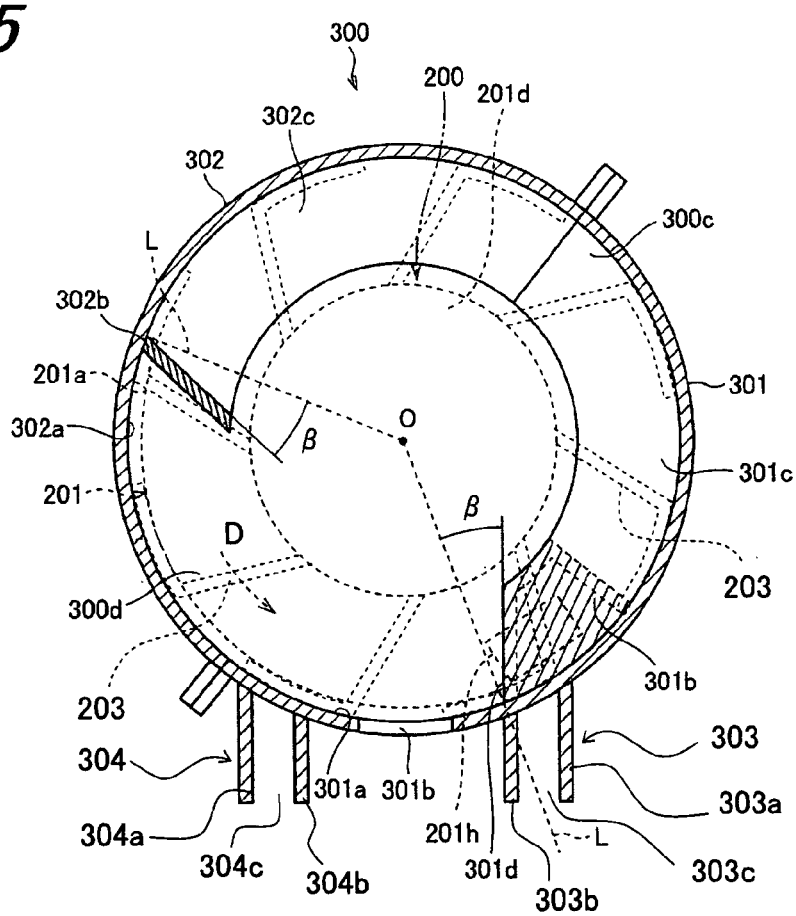
FIG. 15 is an illustrative view showing a positional relationship between a toner discharge chamber of the bottle holder and toner bottle's scrapers.
Figure 16:
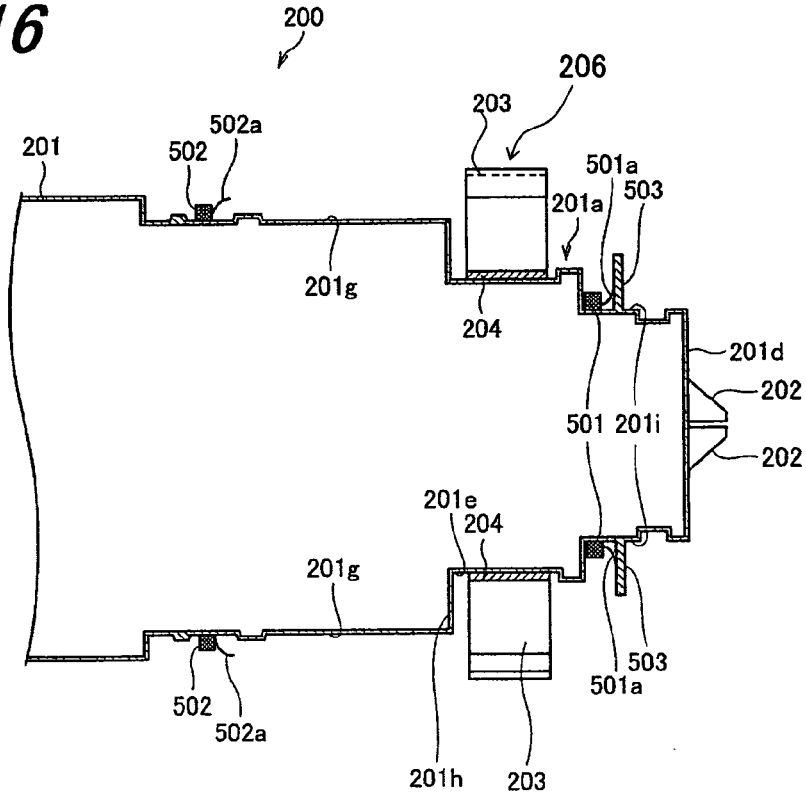
FIG. 16 is a schematic sectional view showing a configuration of the front end part of the toner bottle.

FIG. 13A is a front view showing a configuration of a bottle holder that constitutes a toner supply device according to the present embodiment; FIG. 13B is a perspective view showing the bottle holder, when it is viewed from the rear side; FIG. 14A is a perspective view showing a first casing that constitutes the bottle holder; FIG. 14B is a perspective view showing a second casing that constitutes the bottle holder; FIG. 15 is an illustrative view showing a positional relationship between a toner discharge chamber of the bottle holder and scrapers of the toner bottle; and FIG. 16 is a schematic sectional view showing a configuration of the front end part of the toner bottle.

As shown in FIGS. 7A and 7B described above, bottle holder 300 has an approximately cylindrical configuration, and is composed of a first casing 301 and second casing 302, joined to each other so as to cover front end part 201*a* of main part 201. At the end of the bottle holder 300 an opening 300*a* is formed so as to expose at least ribs 202 which are disposed at front end face 201*d* of front end part 201*a*.

Formed on the exterior of first casing 301 are a pair of plate-like first and second fixing structures (guide portions) 303 and 304 arranged parallel to each other, for fixing toner supply device 100 to image forming apparatus 1. Shutter mechanism 400 for controlling discharge of the toner fed from toner supply device 100 to the outside is arranged between these first and second fixing structures 303 and 304.

Accordingly, in order to make shutter mechanism 400 function correctly, the heights of first and second fixing structures 303 and 304 are adjusted so as to assure a clearance between bottle holder 300 and image forming apparatus 1.

Further, in first fixing structure 303, a pair of rib pieces 303*a* and 303*b* are arranged a predetermined distance apart from one another, forming a guide portion 303*c* extending in the axial direction of toner bottle 200. Also in second fixing structure 304, a pair of rib pieces 304*a* and 304*b* are arranged similarly, forming a guide portion 304*c* along the axial direction.

As shown in FIGS. 13A and 13B, bottle holder 300 has toner discharge port 300*b* formed on the bottom side of first casing 301 between first fixing structure 303 and second fixing structure 304. This toner discharge port 300*b* is adapted to be opened and closed by shutter mechanism 400.

As shown in FIG. 14A, in first casing 301, a first dam portion 301*b* for holding back the toner is formed on the inner peripheral surface, designated at 301*a* near the aforementioned toner discharge port 300*b* and a wall portion 301*c* is extended from this first dam portion 301*b* toward the side opposite to toner discharge port 300*b*. This wall portion 301*c* is arranged a predetermined distance apart from one end face or abutment surface 301*d* inside first casing 301. This distance is specified to be marginally greater than the width of the aforementioned scrapers 203.

Similarly to the first casing 301, second casing 302 is constructed as shown in FIG. 14B so that a second dam portion 302*b* for holding back the toner is formed on the inner peripheral surface, designated at 302*a* and a wall portion 302*c* is extended from this second dam portion 302*b*. This wall portion 302*c* is arranged a predetermined distance apart from one end face or abutment surface 302*d* inside second casing 302. This distance is specified to be marginally greater than the width of the aforementioned scrapers 203.

Joining first casing 301 and second casing 302 constitute the bottle holder 300 as shown in FIG. 13B.

When first casing 301 and second casing 302 are joined, a first space 300*c* is defined by enclosure of first dam portion 301*b* of first casing 301, second dam portion 302*b* of second casing 302, wall portions 301*c* and 302*c*, as shown in FIG. 15.

In the present embodiment, this first space 300*c* is referred to as a toner discharge control chamber for limiting discharge of toner, while the space(second space) other than the first space, between first dam portion 301*b* and second dam portion 302*b*, is designated at 300*d* and referred to as a toner discharge chamber, which functions to discharge the toner from toner bottle 200 after its temporal storage.

Toner discharge control chamber 300*c* is not a space from which toner is actually discharged, but functions as a space for allowing scraper 203 that has ridden over first dam portion 301*b* to pass therethrough. In this case, though some toner which has ridden over first dam portion 301*b* with scrapers 203 exists in toner discharge control chamber 300*c*, this toner will be scraped out from the second dam portion 302*b* side by rotational movement of scrapers 203.

On the other hand, toner discharge chamber 300*d* functions as a space for temporarily storing the toner discharged from bottle-side toner discharge port 201*h* of toner bottle 200.

Here, first dam portion 301*b*'s abutment 301*d* with scraper 203 is inclined in the rotational direction of scraper 203 (in the direction of the arrow in the drawing) as shown in FIG. 15 so that scraper 203 can ride over it properly. That is, abutment surface 301*d* is inclined so that it goes away in the rotational direction of scraper 203 from a normal L from rotational center O of toner bottle 200.

In other words, first dam portion 301*b* is disposed on the upstream side of the scraper 203's direction of toner conveyance, and first dam portion 301*b*'s abutment surface 301*d* with scraper 203 is arranged as a slope forming a predetermined angle β with normal L from the rotational center O, to thereby define toner discharge chamber 300*d*. This angle β is determined as appropriate depending on the scraper 203's material, length and other factors.

As another feature, first dam portion 301*b* is disposed slightly away from toner discharge port 300*b* in the scraper's rotational direction. This arrangement enables easy accommodation of toner in toner discharge chamber 300*d*. In this way, by making toner easily be stored in toner discharge chamber 300*d*, it is possible to keep constant the amount of toner supply to be discharged through toner discharge port 300*b*. Thus, it is possible to realize stable toner supply.

Similarly to first dam portion 301*b*, second dam portion 302*b* is formed so that its abutment surface 302*d* with scraper 203 (the surface on the toner discharge control chamber 300*c* side) is arranged as a slope forming a predetermined angle β with normal L from the rotational center O, to thereby define toner discharge chamber 300*d*. This angle β is determined as appropriate, depending on the scraper 203's material, length and other factors.

In connection to the above, the distance between first dam portion 301*b* and second dam portion 302*b* on the toner discharge chamber 300*d* side should at least have a distance that will not close toner discharge port 300*b*. Since it is necessary to accumulate a certain amount of toner in toner discharge chamber 300*d* from a view point of stable toner supply, the distance should be specified as appropriate in accordance with the desired amount of toner being stored.

In addition, though the aforementioned scraper 203 was mentioned to have a plate-like configuration it should not be limited to this. For example, the scraper may have an approximately V-shaped cross-section. If scraper 203 has an approximately V-shaped cross-section, it can provide sealing function of sealing between the inner peripheral surface of bottle holder 300 and toner bottle 200, hence no separate sealing member is needed.

In accordance with the toner supply assembly 500 thus constructed, since toner bottle 200 is rotatably supported by bottle holder 300, there must be a certain amount of clearance between toner bottle 200 and bottle holder 300. Therefore, if no suitable seal is provided between toner bottle 200 and bottle holder 300, toner will leak out from other than toner discharge port 300*b* of bottle holder 300.

To deal with this, in the present embodiment, two V-rings 501 and 502 for providing a sealing function are attached on front end part 201*a* of main part 201 of toner bottle 200, as shown in FIG. 16.

V-ring 501 is fitted on a peripheral surface 201*i* of front end part 201*a* at a position outside the position where scrapers 203 are fixed, while V-ring 502 is fitted at the end surface, designated at 201*g*, of front end part 201*a* at a position inside the position where scrapers 203 are fixed.

Arranged further outside of the position where V-ring 501 is fitted is a slip ring 503 of a plate-like annular member for creating clearance between toner bottle 200 and bottle holder 300 and allowing toner bottle 200 to rotate smoothly.

V-ring 501 is attached to main part 201 with its sealing flange 501*a* pressed against slip ring 503, while V-ring 502 is attached to main part 201 with its sealing flange 502*a* pressed against the inner peripheral surface (described later) of bottle holder 300. In this way, these two V-rings 501 and 502 provide sealing function.

Slip ring 503 is fitted rotatably on peripheral surface 201*i* of front end part 201*a* of main part 201 and is adapted to be fixed to the inner peripheral surface of bottle holder 300 when toner bottle 200 is attached to bottle holder 300.

With this arrangement, slip ring 503 can be fixed to the bottle holder 300 side, so that main part 201 of toner bottle 200 will rotate along the inner peripheral surface of the slip ring 503.

Now, one example of slip ring 503 will be described with reference to the drawings.

Figure 17:
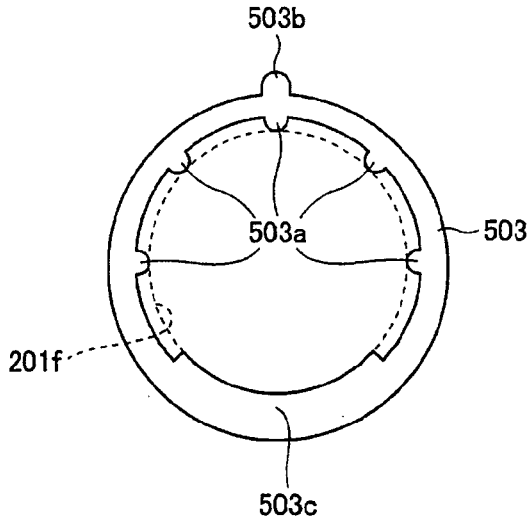
FIG. 17 is a plan view showing a configuration of a slip ring of the toner bottle.
Figure 18:
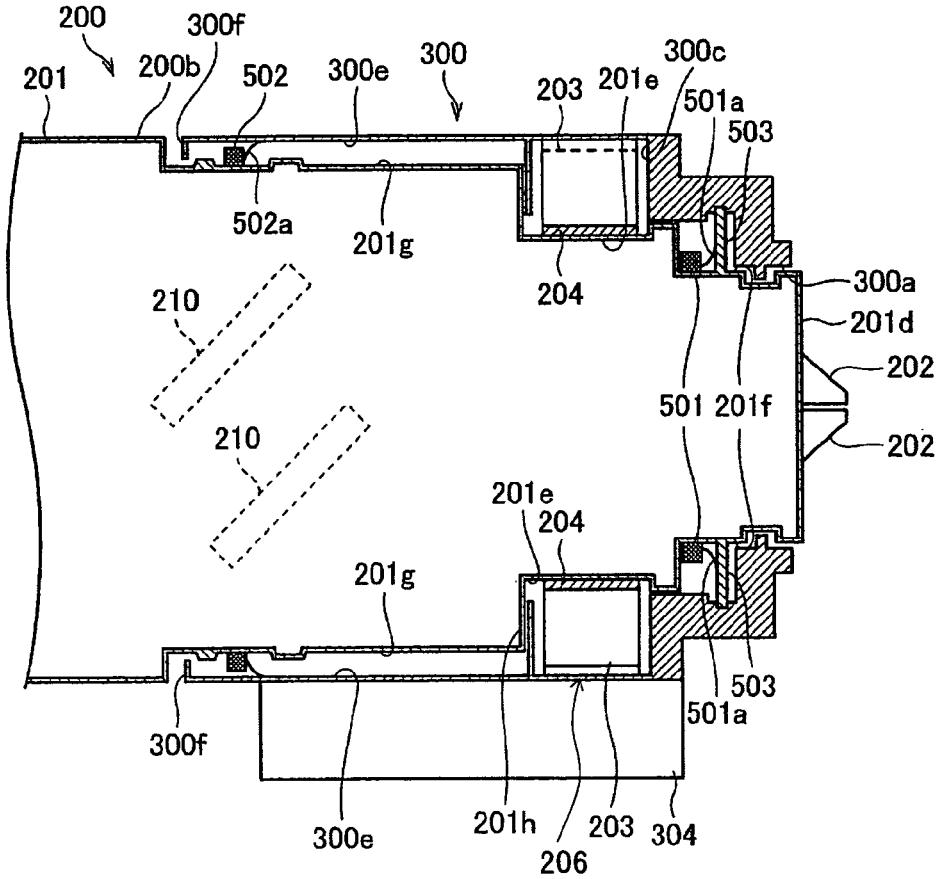
FIG. 18 is a schematic sectional view showing the bottle holder attached to the front end part of the toner bottle.

FIG. 17 is a plan view showing a configuration of the slip ring of a toner bottle as a part of the toner supply device according to the present embodiment, and FIG. 18 is a schematic sectional view showing the bottle holder attached to the front end part of the toner bottle.

As shown in FIG. 17, slip ring 503 is configured so that its inner periphery is formed with a plurality of projections 503*a* that will come into point contact with the fitted surface, i.e., peripheral surface 201*i*, in front end part 201*a* of main part 201 and an essentially arced supporting portion 503*c* that has the same curvature as the peripheral surface 201*i* and hence comes into line contact with peripheral surface 201*e* while a projection 503*b* is formed at the top of the outer peripheral surface. This projection 503*b* is fitted into an unillustrated cutout formed on the inner peripheral surface of bottle holder 300.

Since, in general, slip ring 503 and main part 201 of toner bottle 200 are adapted to slide along each other, it is possible to rotate toner bottle 200 smoothly without load if friction therebetween is minimized.

Accordingly, provision of multiple projections 503*a* that come into point contact with peripheral surface 201*i* on the inner peripheral surface of slip ring 503 as shown in FIG. 17 reduces the total contact area between toner bottle 200 and slip ring 503, hence making it possible to reduce friction between slip ring 503 and main part 201 of toner bottle 200. In this way, it is possible to reduce the rotational load which arises due to increase in friction, and hence rotate toner bottle 200 smoothly inside slip ring 503.

It is noted that the shape of slip ring 503 should not be limited to the configuration shown in FIG. 17, but slip ring 503 may have a shape that supports toner bottle 200 at pointed contacts, such as a polygonal shape, for example.

In sum, plate-like slip ring 503 has, on its inner periphery, an arc of line-contact projection 503*c*, which ranges in a predetermined angle and is margined with a predetermined clearance over peripheral surface 201*i* of toner bottle 201 and the remaining arc having a greater radius with multiple projections 503*a* projected inwards in parts therefrom.

With this configuration, the bottle can be supported by arced area at its bottom where the bottle weight acts thereon to prevent abrasion while the other part is supported by essentially pointed contacts, of multiple projections arranged at intervals of a predetermined distance or, of a polygonal shape, whereby it is possible to reduce the sliding load.

Further, since sealing flange 501*a* (FIG. 16) of V-ring 501 is adapted to abut this slip ring 503, it is possible to reliably prevent toner from leaking downward (in the direction of gravity) in bottle holder 300.

Also, V-ring 502 is attached to front end part 201*a* as shown in FIG. 18 so that its sealing flange 502*a* comes into pressing contact with inner peripheral surface 300*e* of bottle holder 300 when front end part 201*a* of main part 201 of toner bottle 200 is supported by bottle holder 300. This construction makes it possible to prevent toner leakage from the rear end 300*f* side of bottle holder 300.

It should be noted that the joint between first casing 301 and second casing 302 is also properly sealed.

As described above, any portion of bottle holder 300 which is likely to cause toner leakage is completely sealed.

Further, formed on the peripheral surface of front end part 201*a* of main part 201 of toner bottle 200 are a plurality of plate-like ribs 210 made of elastic resin etc., and arranged obliquely in parallel to each other, as shown in FIG. 18, so that these ribs 210 will come into pressure contact with inner peripheral surface 300*e* of bottle holder 300 when toner bottle 200 is held by bottle holder 300. With this arrangement, it is possible to push out the toner that has entered the gap between toner bottle 200 and bottle holder 300 as these ribs 210 rotate.

As described, bottle holder 300 is composed of two separate casings, namely first and second casings 301 and 302, being joined together. When these first and second casings 301 and 302 are detachably joined, it is possible to easily replace the expendable sealing elements (V-rings 501, 502, slip ring 503, ribs 202) by unjoining first and second casings 301 and 302 when maintenance of toner supply device 100 is needed. This means improvement in maintenance of toner supply device 100.

In general, in order to avoid toner leakage and other defects, bottle holder 300 and toner bottle 200 need to be formed with dimensional accuracy, particularly in the supported portion of toner bottle 200 by bottle holder 300.

However, since toner bottle 200 is usually formed by blow molding, the toner bottles are prone to include variations in size when they are molded. Similarly, bottle holder 300 is also formed by blow molding, so that the bottle holders are prone to include variations in size when they are molded.

In the above embodiment, since V-ring 502 is made to provide sealing function by pressing its sealing flange 502*a* into contact with inner peripheral surface 300*e* of bottle holder 300 as described above, it is possible to absorb the size variations of bottle holder 300 and toner bottle 200 originating from molding, in the clearance between toner bottle 200 and bottle holder 300, or more clearly, in the space formed between the surface of main part 201 of toner bottle 200 and bottle holder 300.

Next, shutter mechanism 400 will be described with reference to the drawings.

Figure 19A:
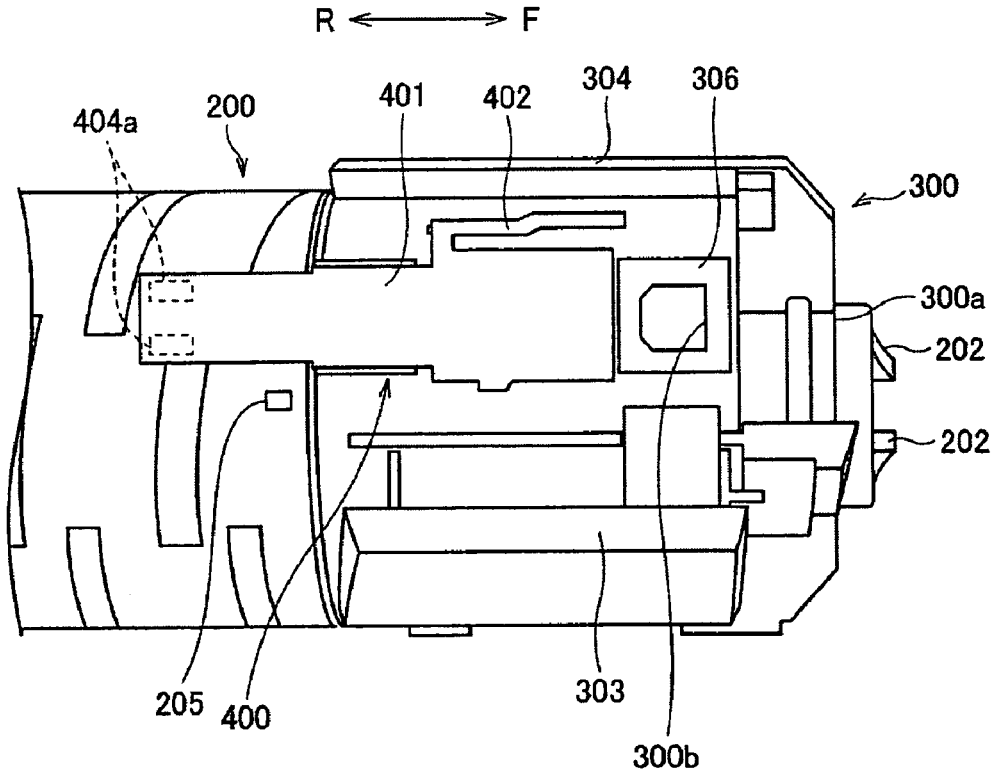
FIG. 19A is an illustrative view showing the bottle holder with its toner discharge port open.
Figure 19B:
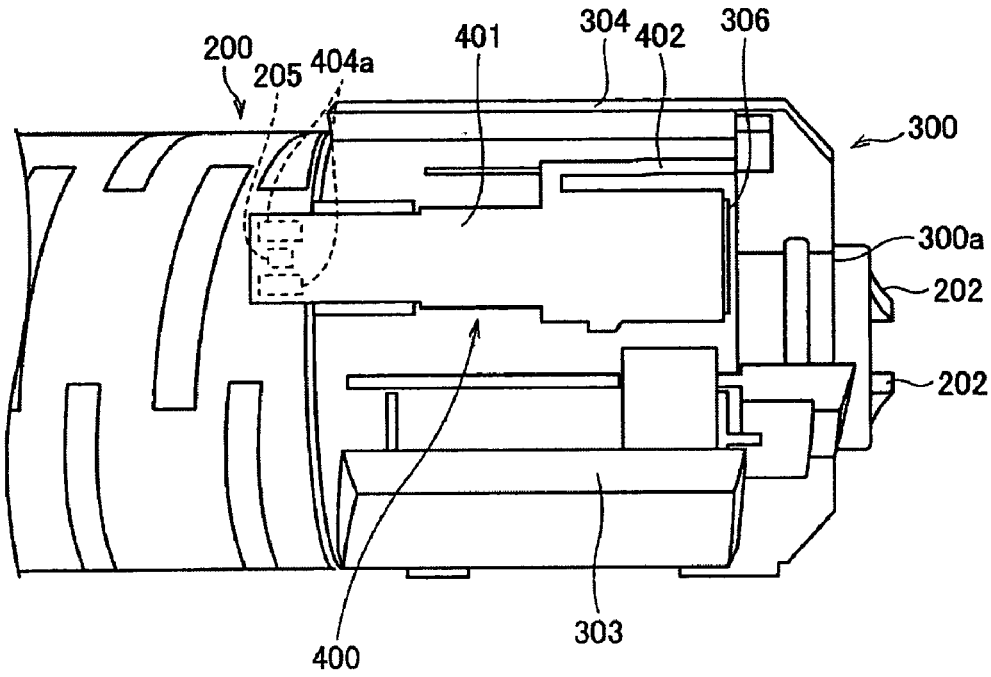
FIG. 19B is an illustrative view showing the bottle holder with the toner discharge port closed by a shutter mechanism.
Figure 20:
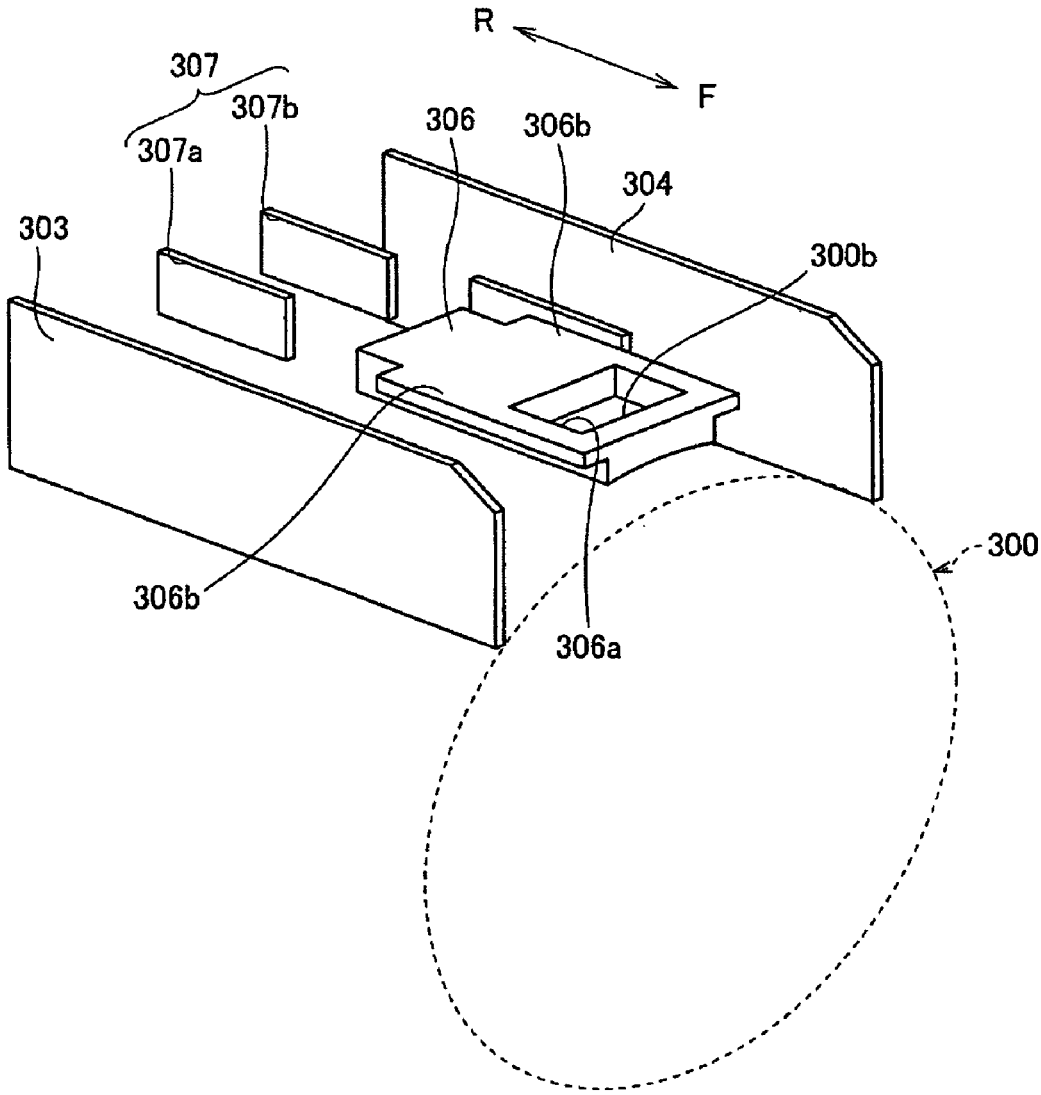
FIG. 20 is an illustrative view showing the schematic structure of the rear side of the bottle holder.

FIG. 19A is an illustrative view showing the bottle holder with its toner discharge port open, FIG. 19B is an illustrative view showing the bottle holder with the toner discharge port closed by a shutter mechanism, and FIG. 20 is an illustrative view showing the schematic structure of the rear side of the bottle holder.

As shown in FIGS. 19A and 19B, shutter mechanism 400 has a plate-like shutter member 401 that is slidable in the directions of arrows F and R, in the bottom of bottle holder 300. In the present embodiment, the side on which ribs 202, 202 of toner bottle 200 are projected from opening 300*a* at the front end of bottle holder 300 is called the front (F) side and the opposite is called the rear (R) side.

In shutter mechanism 400, as shutter member 401 slides in the direction of arrow R, toner discharge port 300*b* of bottle holder 300 is opened, as shown in FIG. 19A. When shutter member 401 slides in the direction of arrow F, toner discharge port 300*b* of bottle holder 300 is closed, as shown in FIG. 19B.

As shown in FIG. 20, bottle holder 300 is formed with first and second guide members 306 and 307 for guiding shutter member 401.

First guide member 306 is a flat plate-like member essentially parallel to the bottom surface of bottle holder 300 and is formed with an opening 306*a* that communicates with toner discharge port 300*b* of the bottle holder 300. Further, the side edge portions 306*b*, 306*b*, of first guide member 306, located at both sides with respect to the directions of arrows F and R, are formed to be thin with the attachment side to bottle holder 300 indented at both sides. These side edge portions 306*b*, 306*b* will function as guide rails for shutter member 401.

On the other hand, second guide member 307 consists of two guide plates 307*a* and 307*b* with their plate surfaces opposing each other, which are extended in the direction of arrow R on the downstream side, with respect to the direction of arrow R, of the attachment position of first guide member 306. These guide plates 307*a* and 307*b* will function as guide rails for shutter member 401.

Now, shutter member 401 will be described with reference to the drawings.

Figure 21A:
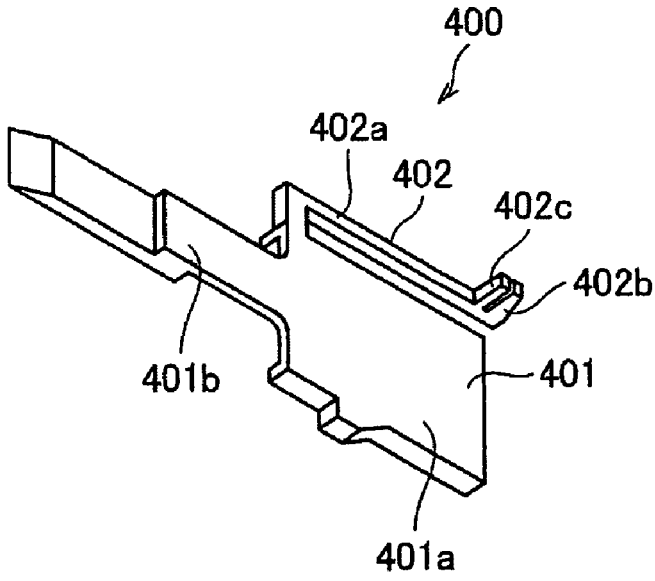
FIG. 21A is a perspective view showing the configuration of a shutter mechanism for a toner supply device in accordance with the present embodiment, when viewed from the front side.
Figure 21B:
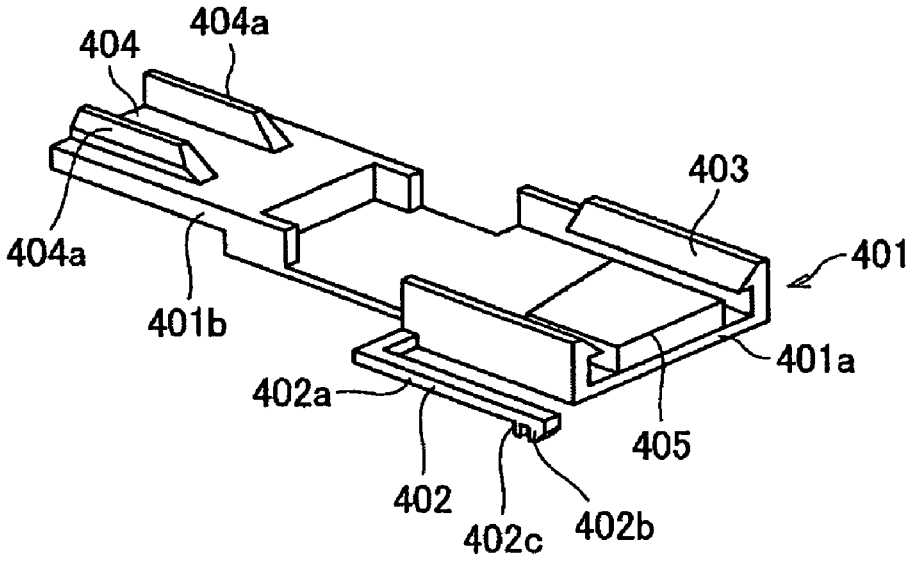
FIG. 21B is a perspective view showing the shutter mechanism when viewed from the rear side.
Figure 22A:
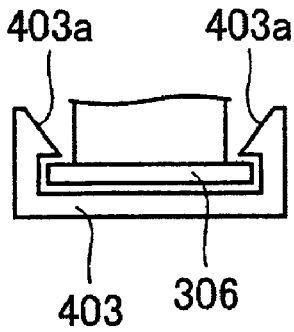
FIG. 22A is an illustrative view showing the relationship between the shutter mechanism and a first guide member of the bottle holder.
Figure 22B:
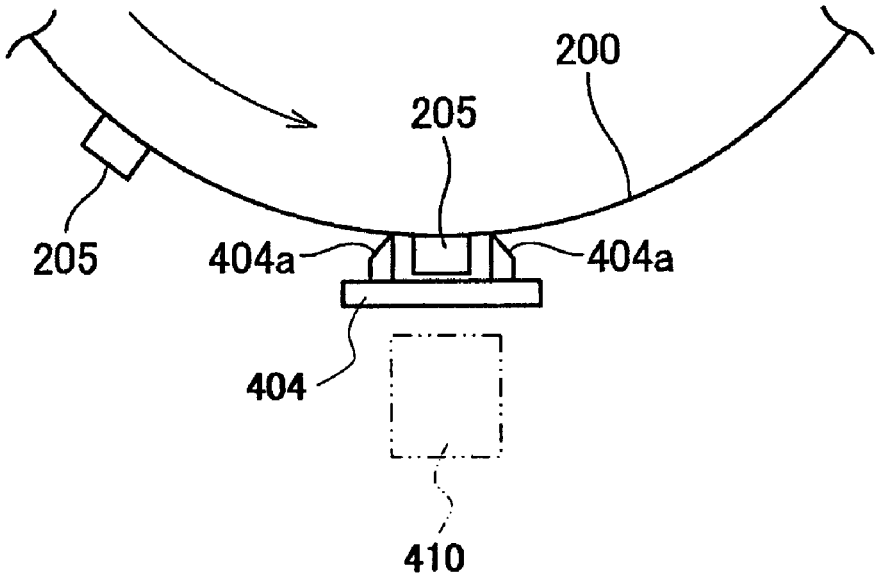
FIG. 22B is an illustrative view showing the relationship between the shutter mechanism and the rotation of the toner bottle.

FIG. 21A is a perspective view, viewed from the front side, showing the configuration of the shutter mechanism for the toner supply device in accordance with the present embodiment, FIG. 21B is a perspective view showing the shutter mechanism when viewed from the rear side, FIG. 22A is an illustrative view showing the relationship between the shutter mechanism and the first guide member of the bottle holder, and FIG. 22B is an illustrative view showing the relationship between the shutter mechanism and the rotation of the toner bottle.

Shutter member 401 is made of plate-like resin, and is composed of a shutter part 401*a* for actually covering the opening and a guide part 401*b* extended from the shutter part 401*a*.

As shown in FIG. 21A, shutter part 401*a* is formed with a regulating member 402 for limiting movement of shutter member 401. This regulating member 402 is composed of an essentially L-shaped main piece 402*a* connected at its one end to shutter part 401*a* and first and second hooks 402*b* and 402*c* formed in the end opposite to the connected side with shutter part 401*a* of main piece 402*a*.

A gap of a predetermined distance is formed between first and second hooks 402*b* and 402*c*. The gap distance is determined such that the front end of second hook 402*c* touches first hook 402*b* when the former falls down towards the latter.

On the undersurface of shutter part 401*a*, a first slider 403 that slidably holds first guide member 306 (FIG. 20) having toner discharge port 300*b* of the aforementioned bottle holder 300 is formed extending in the longitudinal direction of shutter member 401, as shown in FIG. 21B. That is, as shown in FIG. 22A, first slider 403 slidably holds first guide member 306 by means of a pair of hooks 403*a*, 403*a* arranged at both sides.

On the underside of guide part 401*b*, a second slider 404 that is slidably supported by guide plates 307*a* and 307*b* of second guide member 307 is formed extending in the longitudinal direction of shutter member 401, as shown in FIG. 21B. Second slider 404 has a pair of slide plates 404*a*, 404*a* to be guided by guide plates 307*a*, 307*a* of second guide member 307.

Further, formed on the rear side (FIG. 21B) of shutter part 401*a* is a spongy Mylar seal 405 for hermetically sealing toner discharge port 300*b* of bottle holder 300. The size of Mylar seal 405 is not particularly limited as long as it can hermetically seal the toner discharge port 300*b* when shutter part 401*a* of shutter member 401 covers toner discharge port 300*b*.

Concerning slide plates 404*a*, 404*a* (FIG. 21B) of second slider 404, when shutter member 401 has moved to the arrow-F side (FIG. 20), or when opening 300*a* of bottle holder 300 is closed, projecting piece 205 (FIGS. 19A and 19B) formed on the toner bottle 200 surface fits between slide plates 404*a*, 404*a* as shown in FIG. 22B to thereby restrain the toner bottle 200 from rotating. When shutter member 401 is moved in the direction of arrow R, slide plates 404*a*, 404*a* also move in the direction of arrow R to thereby cancel the engagement with projecting piece 205 (FIG. 19A).

This movement cancels restraint on toner bottle 200's rotation. That is, when toner discharge port 300*b* of bottle holder 300 is released so that toner supply device 100 makes a toner supply operation, rotation of toner bottle 200 will not be hindered.

Next, toner supply assembly mounting mechanism 600 will be described with reference to the drawings.

Figure 23:
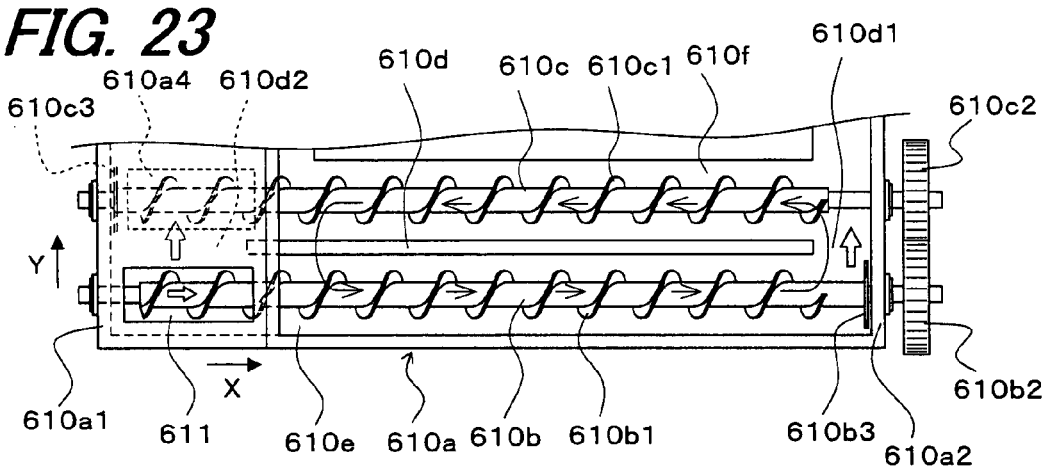
FIG. 23 is an illustrative view showing the structure of the toner supply assembly mounting mechanism.
Figure 24:
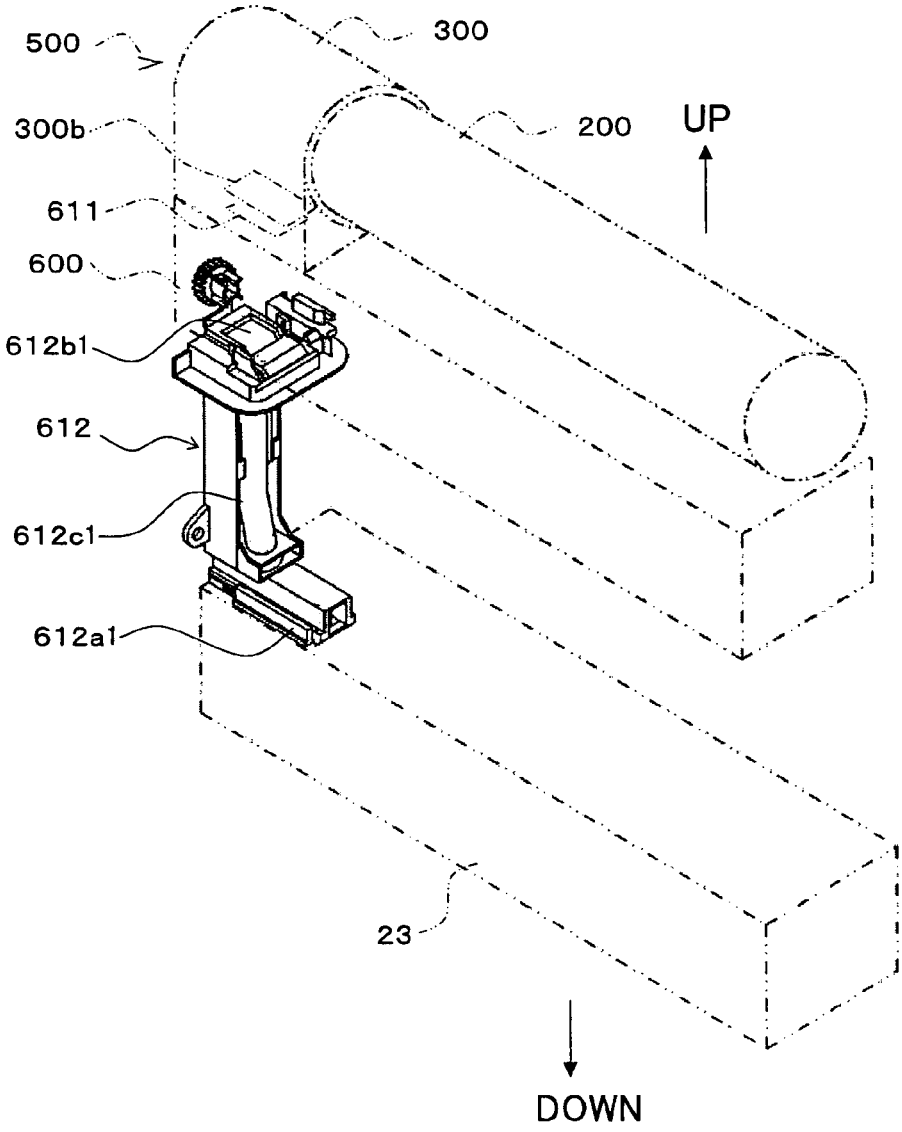
FIG. 24 is an illustrative view showing the structure of a supply passage part for coupling the toner supply assembly mounting mechanism with a developing unit.

FIG. 23 is an illustrative view showing the structure of a toner supply assembly mounting mechanism as a part of a toner supply device according to the present embodiment, and FIG. 24 is an illustrative view showing the structure of a supply passage part for coupling the toner supply assembly mounting mechanism with a developing unit.

As shown in FIGS. 1, 2, 5 and 6, toner supply assembly mounting mechanism 600 is constructed such that toner supply assembly 500 is disposed essentially parallel to, and opposing, developing unit 23 with transfer belt unit 30 disposed therebetween. Toner supply assembly mounting mechanism 600 is constructed so that two toner supply assemblies 500*a* for storing black toner can be mounted together.

In toner supply assembly mounting mechanisms 600, mount bases 602 (602*a* to 602*d*, FIGS. 5 and 6) onto which toner supply assemblies 500 are mounted are formed lengthwise in the direction (the transfer belt width direction) approximately perpendicular to the transfer belt's direction of conveyance.

As shown in FIG. 5, toner supply assemblies 500 are fixed to corresponding drive mechanisms 701 (701*a* to 701*d*), respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to the bottle by coupling itself with toner bottle 200's ribs 202 (FIG. 7) that are projected from opening 300*a* of the aforementioned bottle holder 300. Usually, the actuator is composed of a motor, and is controlled to drive in accordance with the condition of toner being supplied.

On the other hand, holding belt 702 (FIG. 5) is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 is rotatable or touching the toner bottle 200 with such friction as to allow the bottle to rotate.

In toner supply assembly mounting mechanism 600, the mount base 602 on which toner supply assembly 500 is to be mounted, has a toner feed port 611 (611*a*, 611*b*, 611*c* or 611*d*) on the upper surface thereof as shown in FIG. 6. This toner feed port is disposed at one end side on the upper surface where bottle holder 300 of toner supply assembly 500 is mounted, correspondingly to shutter mechanism 400 for the bottle holder 300. On the underside of the mount base, supply passage part 612 (612*a*, 612*b*, 612*c* or 612*d*) for toner conveyance is provided to establish communication between the toner supply port 611 and developing unit 23 that is arranged under toner supply assembly mounting mechanism 600.

Here in FIG. 6, for description convenience, mount base 602*a* corresponding to toner supply assembly 500*a* of black toner is partially omitted.

Supply passage part 612*a* provided in mount base 602*a* for toner supply assembly 500*a* for black toner has two toner feed ports 611*a*, 611*a* corresponding to two toner supply assemblies 500*a*. That is, this supply passage part is constructed so as to receive toner fed from the two ports and feed the toner to single developing unit 23*a* for black toner through toner input port 234*a* (FIGS. 2 and 3) formed in developing unit 23*a*.

Each toner supply assembly mounting mechanism 600 is constructed as shown in FIGS. 3 and 23 such that toner fed from toner supply assembly 500 is delivered from toner feed port 611 that is disposed outside the area of the transfer belt with respect to the direction perpendicular to the transfer belt's direction of conveyance, or in short, outside the width W of the transfer belt.

On the other hand, each of mount bases 602*b* to 602*d* of toner supply assemblies 500*b* to 500*d* for cyan, magenta and yellow toners is formed with a casing 610*a* (FIG. 23) that has a box shape elongated in the width direction of the transfer belt. The casing 610*a* incorporates a first toner agitator shaft (toner conveyor means) 610*b* and a second toner agitator shaft (toner conveyor means) 610*c*, arranged parallel to each other along the axis direction of developing roller 231.

The interior of casing 610*a* is divided into a first toner chamber (toner reservoir) 610*e* with first toner agitator shaft 610*b* disposed therein and a second toner chamber (toner reservoir) 610*f* with second toner agitator shaft 610*c* disposed therein, by a partitioning element 610*d*.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the direction of toner conveyance so as to receive the toner being conveyed.

Here, the toner agitating means should not be limited to screws 610*b*1 and 610*c*1, but it may be a structure in which a multiple number of agitating vanes tilted with the direction of toner conveyance are formed on the first and second toner agitator shafts 610*b* and 610*c*, for example. Also any other configuration can be used as long as it can achieve the same effect.

Partitioning element 610*d* is formed in casing 610*a* in its longitudinal direction or along the first and second agitator shafts 610*b* and 610*c*, having toner chamber communication ports 610*d*1 and 610*d*2 formed near both side walls of casing 610*a* to allow for toner passage between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner feed port 611 for receiving toner supply from toner bottle 200 arranged on the top thereof is formed while a toner feed port 610*a*4 for delivering the toner from casing 610*a* to supply passage part 612 (FIGS. 2 and 3) that feeds toner to developing unit 23 arranged below is formed.

The opening of toner feed port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating and circulatively conveying toner from second end side 610*a*2 to first end side 610*a*1 of casing 610*a*.

Each supply passage part 612 is formed so that its top is integrated with toner supply assembly mounting mechanism 600, and a developing unit attachment portion 612*a*1 for detachable attachment to developing unit 23 is provided at the bottom thereof, as shown in FIG. 24.

An opening of a toner input port 612*b*1 for toner input is formed at the top of supply passage part 612, and a toner passage 612*c*1 for toner to pass from this toner input port 612*b*1 to developing unit attachment portion 612*a*1 is provided approximately linearly from top to bottom.

Further, as shown in FIG. 6, at one end side on the top of casing 610*a* of mount base 602, bottle holder guide portions 620, 620 that engage guide portions 303*c* and 304*c* (FIG. 7B) of first and second fixing structures 303 and 304 are projectively formed at the positions opposing first and second fixing structures 303 and 304 (FIG. 7B) of bottle holder 300 when toner supply assembly 500 has been mounted. Bottle holder guide portions 620, 620 are arranged essentially parallel to each other with toner feed port 611 positioned therebetween and extended in the longitudinal direction of mount base 602.

Toner feed port 611 of mount base 602 is formed at the position corresponding to shutter member 401 (FIG. 19A) of shutter mechanism 400 provided for bottle holder 300 when toner supply assembly 500 is mounted. In other words, toner feed port 611 is formed at a position so as to be able to receive toner discharged from toner discharge port 300*b* when the toner discharge port 300*b* of bottle holder 300 is released by shutter mechanism 400.

Formed in the vicinity of toner feed port 611 is a projection piece 613 (613*a* to 613*d*, FIG. 6), which is hooked by a hooking portion (described later) of regulating member 402 (FIGS. 19A and 21A) provided for shutter member 401 of shutter mechanism 400 to limit the movement of shutter member 401.

On the side longitudinally opposite to toner feed port 611 of mount base 602, a supporter 614 (614*a* to 164*d*) for supporting the rear end (the end on the side opposite to the mounted portion of bottle holder 300) of toner bottle 200 when toner supply device 100 is mounted is formed.

This supporter 614 is to create a predetermined clearance between toner bottle 200 and mount base 602 and functions to smoothen the rotation of toner bottle 200. Here, the configuration and the like of supporter 614 is not particularly limited; any configuration and material can be used as long as it permits toner bottle 200 to rotate smoothly.

The forming position of projection piece 613 provided near toner feed port 611 is determined by the regulatory operation of regulating member 402.

Next, how the forming position of projection piece 613 is determined will be described with reference to the drawings.

Figure 25A:
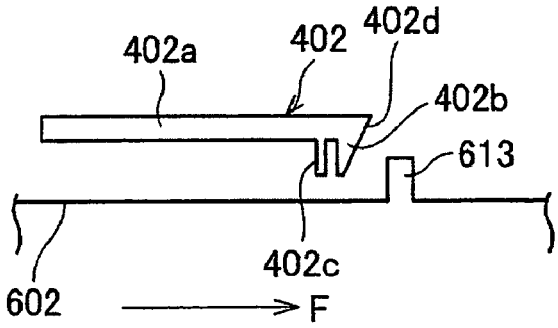
FIG. 25A is an illustrative view showing the positional relationship between a regulating member and a projection piece before the toner supply device is mounted to a mount base.
Figure 25B:
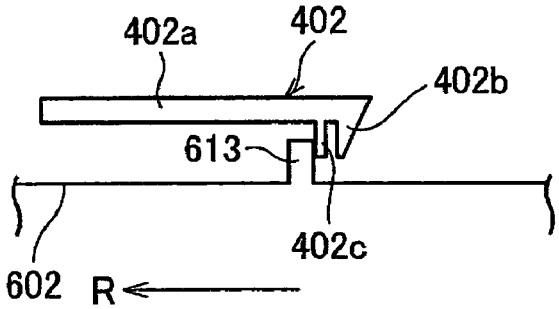
FIG. 25B is an illustrative view showing the positional relationship between the regulating member and the projection piece when the toner supply device has been mounted to the mount base.
Figure 25C:
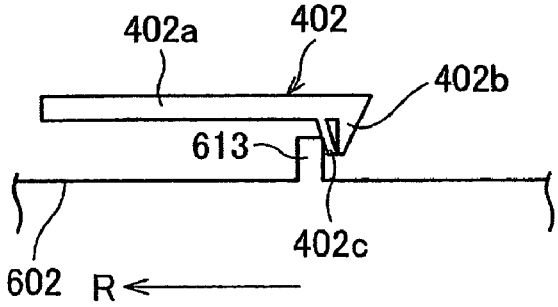
FIG. 25C is an illustrative view showing the positional relationship between the regulating member and the projection piece when the toner supply device is dismounted from the mount base.

FIG. 25A is an illustrative view showing the positional relationship between the regulating member and the projection piece before the toner supply device according to the present embodiment is mounted to the mount base; FIG. 25B is an illustrative view showing the positional relationship between the regulating member and the projection piece when the toner supply device has been mounted to the mount base; and FIG. 25C is an illustrative view showing the positional relationship between the regulating member and the projection piece when the toner supply device is dismounted from the mount base.

Projection piece 613 is formed at such a position that shutter member 401 will open toner discharge port 300*b* of bottle holder 300 by its engagement with regulating member 402 when toner supply device 100 has been completely attached to mount base 602 and will close toner discharge port 300*b* of bottle holder 300 when toner supply device 100 is removed from mount base 602.

Regulating member 402 has first hook 402*b* and second hook 402*c* formed at the front end (on the side of engagement with projection piece 613) of main piece 402*a*, as already mentioned.

First hook 402*b* is disposed at a position more front than second hook 402*c* and its abutment surface 402*d* against projection piece 613 is formed beveled so that it can easily ride over the projection piece 613. Here, abutment surface 402*d* is so inclined that its contact area with the top of projection piece 613 is minimized.

When abutment surface 402*d* of first hook 402*b* is inclined in this way, regulating member 402 is moved in the direction of arrow F from the state shown in FIG. 25A, and first hook 402*b* rides over projection 613 formed on first casing 301. With a further movement of the regulating member, second hook 402*c* also rides over projection 613. From this state, when regulating member 402 is caused to move in the direction opposite to the direction of arrow F, movement of regulating member 402 is obstructed by projection piece 613 and second hook 402*c* (the state shown in FIG. 25B).

Next, how toner supply device 100 is mounted to the image forming apparatus will be described.

Toner supply device 100 is adapted to be mounted to toner supply assembly mounting mechanism 600 by sliding bottle holder 300 side of toner supply assembly 500 over and along mount base 602 of toner supply assembly mounting mechanism 600.

By this sliding movement of toner supply assembly 500, shutter member 401 of shutter mechanism 400, provided for bottle holder 300, opens or closes toner discharge port 300*b* of the bottle holder 300, as shown in FIGS. 25A, 25B and 25C.

Movement of shutter member 401 is controlled by regulating member 402 that is integrally formed with shutter member 401.

In the case where toner discharge port 300*b* of bottle holder 300 is opened by shutter mechanism 400, as shutter member 401 moves in the direction of arrow R, regulating member 402 moves and takes the state shown in FIG. 25B. Then, with a further movement in the direction of arrow R, second hook 402*c* abuts projection piece 613 and falls down to the first hook 402*b* side, as shown in FIG. 25C, so that the first hook 402*b* together with second hook 402*c* ride over projection piece 613 as the movement in the direction of arrow R continues. In this way, toner discharge port 300*b* of bottle holder 300 is made open.

In the case where toner supply assembly 500 is dismounted from toner supply assembly mounting mechanism 600, as toner supply assembly 500 is pulled out from toner supply assembly mounting mechanism 600, the aforementioned actions take place in the reverse order, that is, shutter member 401 moves in the direction of arrow F (FIG. 25A) so that toner discharge port 300*b* of bottle holder 300 is closed.

Next, the operation of supplying toner to developing unit 23 by toner supply device 100 using toner bottle 200 will be described.

Toner bottle 200 has been mounted to toner supply assembly mounting mechanism 600 with bottle-side toner discharge port 201*h* sealed with sealing element 220.

When toner is supplied to developing unit 23, driving mechanism 701 provided for toner supply assembly mounting mechanism 600 causes toner bottle 200 to rotate. As a result, sealing element 220 is peeled off toner bottle 200 first to open bottle-side toner discharge port 201*h* of toner bottle 200, so that toner will be able to be supplied from bottle-side toner discharge port 201*h*.

As toner bottle 200 further rotates, toner discharged from toner bottle 200 is conveyed and supplied from the interior of bottle holder 300 to toner supply assembly mounting mechanism 600 by means of scrapers 203 that are integrally formed with toner bottle 200 as shown in FIGS. 3 and 13A, and the toner is agitated by the toner supply assembly mounting mechanism 600, then fed to developing unit 23.

When toner supply is halted, the rotation of toner bottle 200 is stopped so as to quit toner conveyance from toner bottle 200. At this point, the movement of toner bottle 200 is controlled by an unillustrated rotational position detecting sensor for sensing toner bottle 200 so that one lid portion 203*b* of multiple scrapers 203 will be positioned to oppose toner discharge port 300*b* of bottle holder 300.

With this arrangement, toner discharge port 300*b* of bottle holder 300 can be closed by lid portion 203*b* of scraper 203 when toner bottle 200 stops rotating, so that it is possible to totally block toner supply. As a result, even if image forming apparatus 1 is moved or even shaken, there is no risk of toner being unintentionally delivered from toner supply device 100 to developing unit 23.

Next, one characteristic configuration of toner bottle 200 in the embodiment according to the present invention will be described with reference to the drawings.

Figure 26:
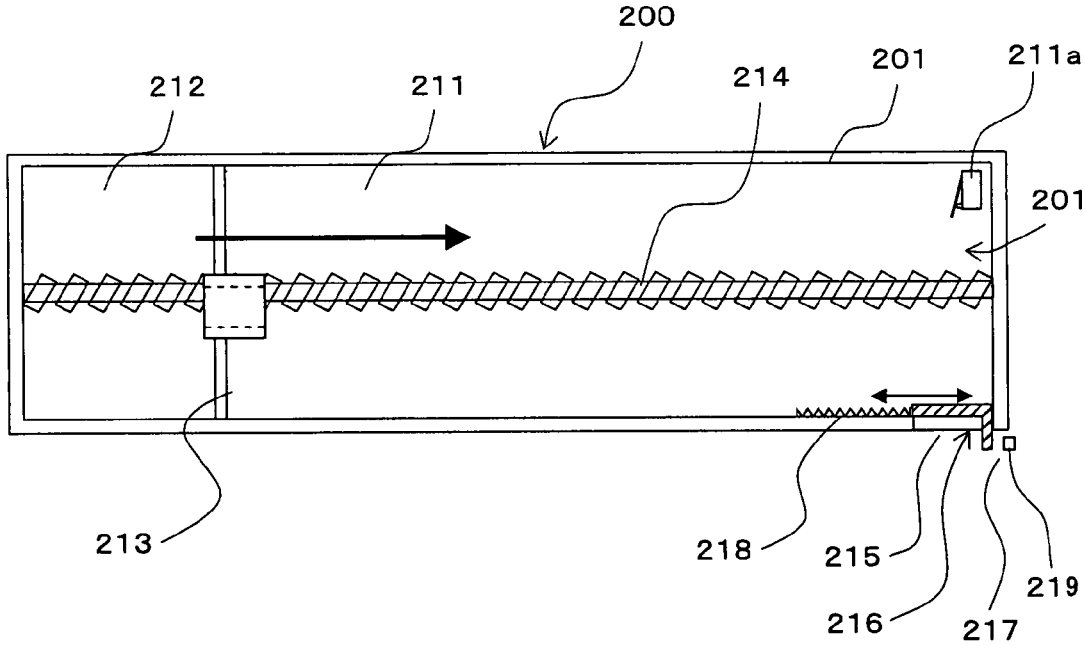
FIG. 26 is a schematic illustrative view showing the internal structure of the toner bottle.

FIG. 26 is a schematic illustrative view showing the internal structure of the toner bottle according to the present embodiment.

As shown in FIG. 26, toner bottle 200 includes a partitioning plate (partitioning member) 213 for separating the interior into a toner storing compartment 211 for storing toner therein and an empty space 212 with no toner therein and a feed shaft (partitioning member moving means) 214 for moving partitioning plate 213 in the axial direction of toner bottle 200, both arranged in main part 201.

Feed shaft 214 is formed of a screw shaft and is rotatably arranged with an unillustrated motor etc. Partitioning plate 213 is moved left and right along the axial direction of toner bottle 200 in the drawing as the shaft rotates, so that the volume of toner storing compartment 211 is suitably controlled in accordance with the amount of toner left in toner storing compartment 211.

Arranged on the front end 201*a* side of toner storing compartment 211 is a micro switch (remaining toner quantity detector) 211*a* which detects the position of partitioning plate 213 when the volume of toner storing compartment 211 is reduced to a predetermined volume or lower.

That is, micro switch 211*a* is adapted to output a signal by detecting partitioning plate 213 that moves in accordance with the amount of remaining toner when the toner left in toner storing compartment 211 has run short (becomes empty).

In the front end part 201*a* of toner bottle 200 a toner discharge port 215 is formed at the position opposing the toner feed port 611 (FIG. 6) of toner supply assembly mounting mechanism 600*a* (FIG. 6). Also, an outlet slide shutter 216 for opening and closing the toner discharge port 215 is disposed with it.

Outlet slide shutter 216 is configured so as to be able to open and close the toner discharge port 215 as it slides in the axial direction of toner bottle 200. Formed at the toner bottle 200's front end 201*a* side of this slide shutter 216 is a rib 217 that is projected outwards of toner bottle 200 (downwards in the drawing) to engage an engagement piece 634 (FIG. 27) of an after mentioned inlet slide shutter provided for feed port 611*a* of toner supply assembly mounting mechanism 600*a*. On the other hand, a spring element 218 that urges outlet slide shutter 216 forwards in the axial direction of toner bottle 200 is disposed on the opposite side across outlet slide shutter 216, from the rib 217's side.

Outlet slide shutter 216 is adapted to close toner discharge port 215 by means of spring element 218 when in the normal state or when toner bottle 200 is handled alone or is not set on toner supply assembly mounting mechanism 600. The shutter is able to release toner discharge port 215 from the normal state by opposing the repulsive force of spring element 218.

Further, an engagement piece 219 that abuts a rib 632 (FIG. 27) of the inlet slide shutter of toner supply assembly mounting mechanism 600*a* is formed on the front end part 201*a* side of toner bottle 200, at a position more front than rib 217 of outlet slide shutter 216. This rib 632 is smaller in height than rib 217.

This engagement piece 219 is arranged so as to abut the aforementioned rib 632 (FIG. 27) of the inlet slide shutter when toner bottle 200 is set on toner supply assembly mounting mechanism 600*a*.

Next, one characteristic configuration of toner supply assembly mounting mechanism 600 for the above-described toner bottle 200 according to the present invention will be described with reference to the drawings.

Figure 27:
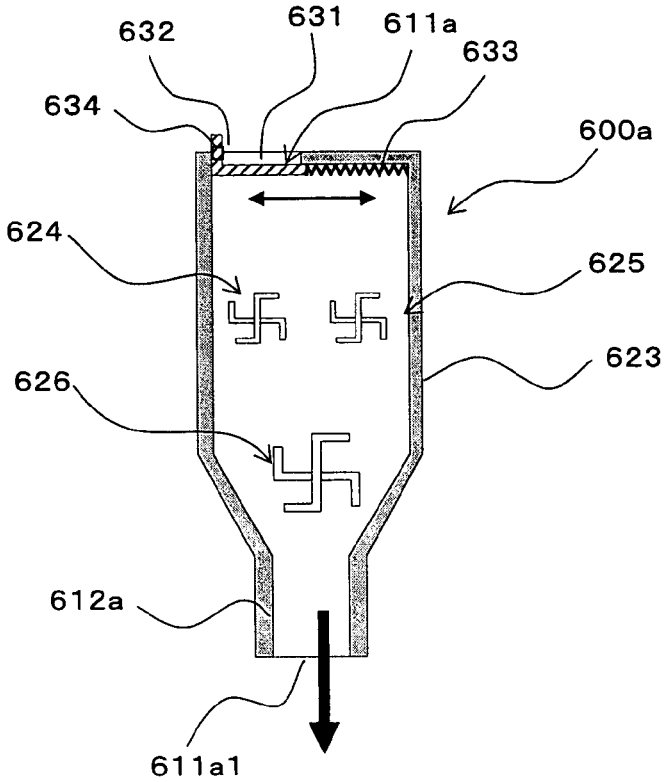
FIG. 27 is a schematic illustrative view showing the configuration of a toner supply assembly mounting mechanism corresponding to the toner bottle.

FIG. 27 is a schematic illustrative view showing the configuration of a toner supply assembly mounting mechanism corresponding to the toner bottle according to the present embodiment.

As shown in FIGS. 6 and 27, toner supply assembly mounting mechanism 600*a* is comprised of a box-shaped casing 623 that forms its exterior and a pair of toner feed ports 611*a*, 611*a* that correspond to two toner bottles 200 formed on the top, and uses the interior of the casing 623 as a temporal reservoir of the toner that is fed from the toner feed ports 611*a*, 611*a*.

In the interior of casing 623, rotors 624, 625 and 626 for agitating stored toner are rotatably supported by unillustrated drive motors. Also, a toner discharge port 611*a*1 for delivering toner to developing unit 23 through toner supply passage part 612*a* is formed at the bottom of casing 623.

Rotors 624 and 625 are laid out correspondingly under toner feed ports 611*a*, 611*a* through which toner is supplied from individual toner bottles 200*a*, 200*a* while rotor 626 is arranged under and between rotors 624 and 625.

Toner feed ports 611*a*, 611*a* are each able to have toner bottle 200 mounted thereto, and as shown in FIGS. 26 and 27, each port has an inlet slide shutter 631 corresponding to outlet slide shutter 216 provided at toner discharge port 215 of each toner bottle 200.

Inlet slide shutter 631 is configured so as to be able to open and close toner feed port 611*a* as it slides in the axial direction of the mounted toner bottle 200. Formed at one end side of inlet slide shutter 631 is the aforementioned, inlet slide shutter's rib 632 that is projected outwards of casing 623 (upwards in the drawing) to engage engagement piece 219 that is formed on the front end 201*a* side of toner bottle 200. On the other hand, a spring element 633 that urges inlet slide shutter 631 in the axial direction of toner bottle 200 to the first side is disposed on the opposite side of inlet slide shutter 631.

Further, inlet slide shutter 631 is adapted to close toner feed port 611*a* by means of spring element 633 when in the normal state or when toner bottle 200 is not set on toner supply assembly mounting mechanism 600*a*. The shutter is able to open toner feed port 611*a* from the normal state by opposing the repulsive force of spring element 633.

Also, on the insert side (left side in the drawing) of toner bottle 200 of toner supply assembly mounting mechanism 600*a*, an engagement piece 634 that abuts rib 217 of outlet slide shutter 216 of toner bottle 200 is formed at a position outside rib 632 of inlet slide shutter 631. This engagement piece 634 is smaller in height than rib 632.

This engagement piece 634 is adapted to abut rib 217 of outlet slide shutter 216 of toner bottle 200 when toner bottle 200 is set on toner supply assembly mounting mechanism 600*a*.

In the present embodiment, outlet slide shutter 216 and inlet slide shutter 631 move along the axial direction of toner bottle 200 when toner bottle 200 is mounted onto toner supply assembly mounting mechanism 600*a*, whereby these shutters slide in opposite directions to open or close the ports.

Next, how toner bottle 200 is mounted to toner supply assembly mounting mechanism 600*a* is described with reference to the drawings.

Figure 28:
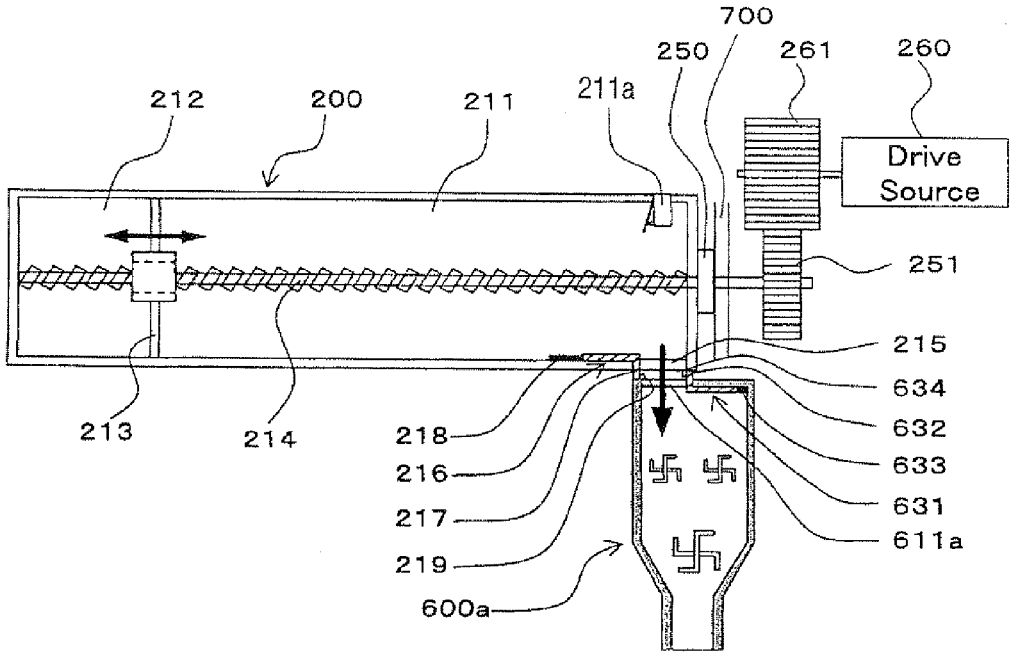
FIG. 28 is a schematic illustrative view showing a state where the toner bottle has been set on the toner supply assembly mounting mechanism.

FIG. 28 is a schematic illustrative view showing a state where the toner bottle has been set on the toner supply assembly mounting mechanism, and FIG. 29 is an illustrative view showing the arrangement of the toner bottles.

When toner bottle 200 is set on toner supply assembly mounting mechanism 600*a*, toner bottle 200 is moved approximately parallel to mount base 602 of toner supply assembly mounting mechanism 600*a*, along the toner bottle 200's axial direction, as shown in FIGS. 28 and 29.

As shown in FIG. 29, two toner bottles 200 (200*a*A and 200*a*B) are set in parallel to each other along the toner bottle's axial direction on mount base 602. Toner bottles 200*a*A and 200*a*B in the embodiment each hold toner of the same color, e.g., black toner, but the toner is not limited to black toner.

As toner bottle 200 moves and begins its mounting to toner supply assembly mounting mechanism 600*a*, engagement piece 219 of toner bottle 200 abuts rib 632 of inlet slide shutter 631 of toner supply assembly mounting mechanism 600*a* while rib 217 of outlet slide shutter 216 of toner bottle 200 abuts engagement piece 634 of toner supply assembly mounting mechanism 600*a*.

As toner bottle 200 further advances, inlet slide shutter 631 on the toner supply assembly mounting mechanism 600*a* side is pushed by engagement piece 219 and moves, opposing the repulsive force of spring element 633, in the direction that permits toner feed port 611*a* to open.

On the other hand, outlet slide shutter 216 on toner bottle 200 side is stopped to move as rib 217 abuts engagement piece 634. Therefore, the shutter 216 relatively moves as toner bottle 200 advances, opposing the repulsive force of spring element 218, in the direction that permits toner discharge port 215 to open.

Then, as toner bottle 200 is completely set to toner supply assembly mounting mechanism 600*a*, inlet slide shutter 631 on the toner supply assembly mounting mechanism 600*a* side is caused by engagement piece 219 to open toner feed port 611 while outlet slide shutter 216 of toner bottle 200 is caused by engagement piece 634 to open toner discharge port 215.

By this action, toner feed port 611*a* on the toner bottle 200 side and toner discharge port 215 on the toner supply assembly mounting mechanism 600*a* side are made to communicate with each other, so that toner can be fed from toner bottle 200 into toner supply assembly mounting mechanism 600*a*.

In this condition, toner bottle 200 is engaged with a coupler 250 provided for a driving device 700 so that the bottle can receive driving force from a drive motor 260. In this coupler 250, a drive transmission gear 251 is arranged coaxially with coupler 250 on the toner bottle 200's axis, on the opposite side across coupler 250, from the toner bottle 200 side, so that it can rotate integrally with coupler 250.

Drive motor 260 is arranged with a drive gear 261 which drives drive transmission gear 251. In this arrangement, as drive motor 260 rotates, feed shaft 214 turns so that partitioning plate 213 moves along feed shaft 214.

When toner bottle 200 is dismounted from toner supply assembly mounting mechanism 600*a*, the above operation is performed in reverse. That is, when toner bottle 200 is removed from toner supply assembly mounting mechanism 600*a*, in toner bottle 200 outlet slide shutter 216 is moved in such a direction to close toner discharge port 215 by the repulsive force of spring element 218, so that toner discharge port 215 is closed by outlet slide shutter 216.

On the other hand, in toner supply assembly mounting mechanism 600*a*, inlet slide shutter 631 is moved in such a direction to close toner feed port 611*a* by the repulsive force of spring element 633, so that toner feed port 611*a* is closed by inlet slide shutter 631.

Next, the detecting operation of the amount of remaining toner in toner bottle 200 according to the present embodiment will be described with reference to the drawings.

In general, supply of toner to developing unit 23 by toner supply device 100 is controlled in accordance with the amount of toner used for the process of printing in developing unit 23.

Toner bottle 200 is controlled so that the volume of toner storing compartment 211 is reduced in accordance with the amount of remaining toner as the amount of toner left therein reduces, as shown in FIG. 28. Illustratively, partitioning plate 213 in toner bottle 200 is controlled to move and vary the volume of toner storing compartment 211.

Specifically, when the amount of toner left in toner bottle 200 reduces as toner is supplied to developing unit 23, feed shaft 214 is controlled to turn so that partitioning plate 213 moves to the toner storing compartment 211 side (to the right in the drawing) hence reduces the volume of toner storing compartment 211.

When partitioning plate 213 has moved close to the end of toner storing compartment 211 (the right side end in the drawing) and the amount of toner remaining in toner bottle 200 becomes empty, partitioning plate 213 abuts micro switch 211*a*, so that the micro switch 211*a* is turned to "On", thus outputting an indication that the toner bottle is empty.

In the present embodiment, the amount of toner left in toner bottle 200 on the way to the empty state can be detected by detecting the position of partitioning plate 213.

That is, a change from the condition in which toner bottle 200 is full of toner to a condition in which the toner in the bottle is supplied to developing unit 23 and hence reduced is adapted to be detected by the shift of the position of partitioning plate 213.

Specifically, the position of partitioning plate 213 when toner bottle 200 is full of toner is stored as a reference position in an unillustrated controller that controls toner supply device 100, and the position of partitioning plate 213 that has been moved as the remaining toner reduces is detected based on that reference position, to thereby determine the amount of toner left in the bottle.

Detection of the position of partitioning plate 213 is performed by measuring the time taken when partitioning plate 213 is moved toward the empty space 212 side of toner bottle 200 till it abuts the inner end wall of the empty space 212 or by determining the number of times of rotation of feed shaft 214 needed to move partitioning plate 213.

The positions of partitioning plate 213 in toner bottle 200, that is, the reference position before toner supply is started and the position after toner supply have been done are adapted to be stored into an unillustrated memory (toner information manager) provided for toner bottle 200 and the controller of toner supply device 100.

The aforementioned positional information of partitioning plate 213 in toner bottle 200 is bi-directionally communicated between the memory (not shown) provided for toner bottle 200 and the controller of toner supply device 100, so that the information can be detected by toner supply device 100 when toner bottle 200 is replaced or when the toner supply device 100 to which toner bottle 200 is mounted is changed.

In the present embodiment, detection of the amount of toner left in toner bottle 200 is adapted to be performed when toner supply device 100 is switched from the deactivated state to the activated state or when the printing operation in developing unit 23 is enabled. With this arrangement, it is possible to acquire the latest information on the amount of toner left in toner bottle 200.

Next, the operation and function of toner supply by toner supply device 100 in image forming apparatus 1 according to the present embodiment will be described with reference to flowcharts.

FIGS. 30A to 30D are flowcharts showing the toner supply operation and function of the image forming apparatus according to the present embodiment.

To begin with, as image forming apparatus 1 with toner supply device 100 provided is activated (Step S1), one of toner bottles 200 to be engaged in supplying toner during printing is determined (Step S2).

In the toner bottles 200 (here, these will be referred to as toner bottles 200*a*A and 200*a*B), partitioning plate 213 in each toner bottle 200 is moved in the direction opposite to that when toner is supplied, until the rotational load on feed shaft 214 increases, and the time of rotation of feed shaft 214 (the time of movement of partitioning plate 213) or the number of times of rotation of the shaft is measured (Step S3).

Increase of the rotational load occurs when partitioning plate 213 collides with the inner wall of toner bottle 200.

From the time of rotation or the number of times of rotation of feed shaft 214 measured as to each of toner bottles 200*a*A and 200*a*B, the amounts of remaining toner in toner bottles 200*a*A and 200*a*B are calculated (Step S4). The thus obtained amounts of remaining toner in toner bottles 200*a*A and 200*a*B will be referred to as (A-1) and (B-1), respectively.

Then, it is determined whether any of toner bottles 200*a*A and 200*a*B is empty (Step S5). If one of the toner bottles is determined to be empty, the operation goes to ① of FIG. 30B. When no bottle is determined to be empty, the operation goes to Step S6.

At Step S6, the amount of remaining toner in toner bottle 200*a*A and that of toner bottle 200*a*B are compared. If (A-1), the amount of remaining toner in toner bottle 200*as*A is greater than (B-1), the amount of remaining toner in toner bottle 200*a*B, the operation goes to ③ of FIG. 30C. When (A-1), the amount of remaining toner in toner bottle 200*a*A is lower than (B-1), the amount of remaining toner in toner bottle 200*a*B, the operation goes to Step S7.

At Step S7, toner bottle 200*a*A is selected to be used to supply toner during the process of printing, and a printing operation is implemented (Step S8).

During the process of printing, the amount of toner supplied from toner bottle 200*a*A, referred to as (A-2) is determined based on the measured time of rotation of, or the number of times of rotation of, feed shaft 214 (Step S9).

Then, by subtracting (A-2), the amount of supplied toner from (A-1), the amount of toner remaining in toner bottle 200*a*A (Step S10), whether there is any toner left in toner bottle 200*a*A is determined (Step S11).

At Step S11, it is determined that there is toner remaining therein, the operation enters the standby mode (S11A).

Figure 30A:
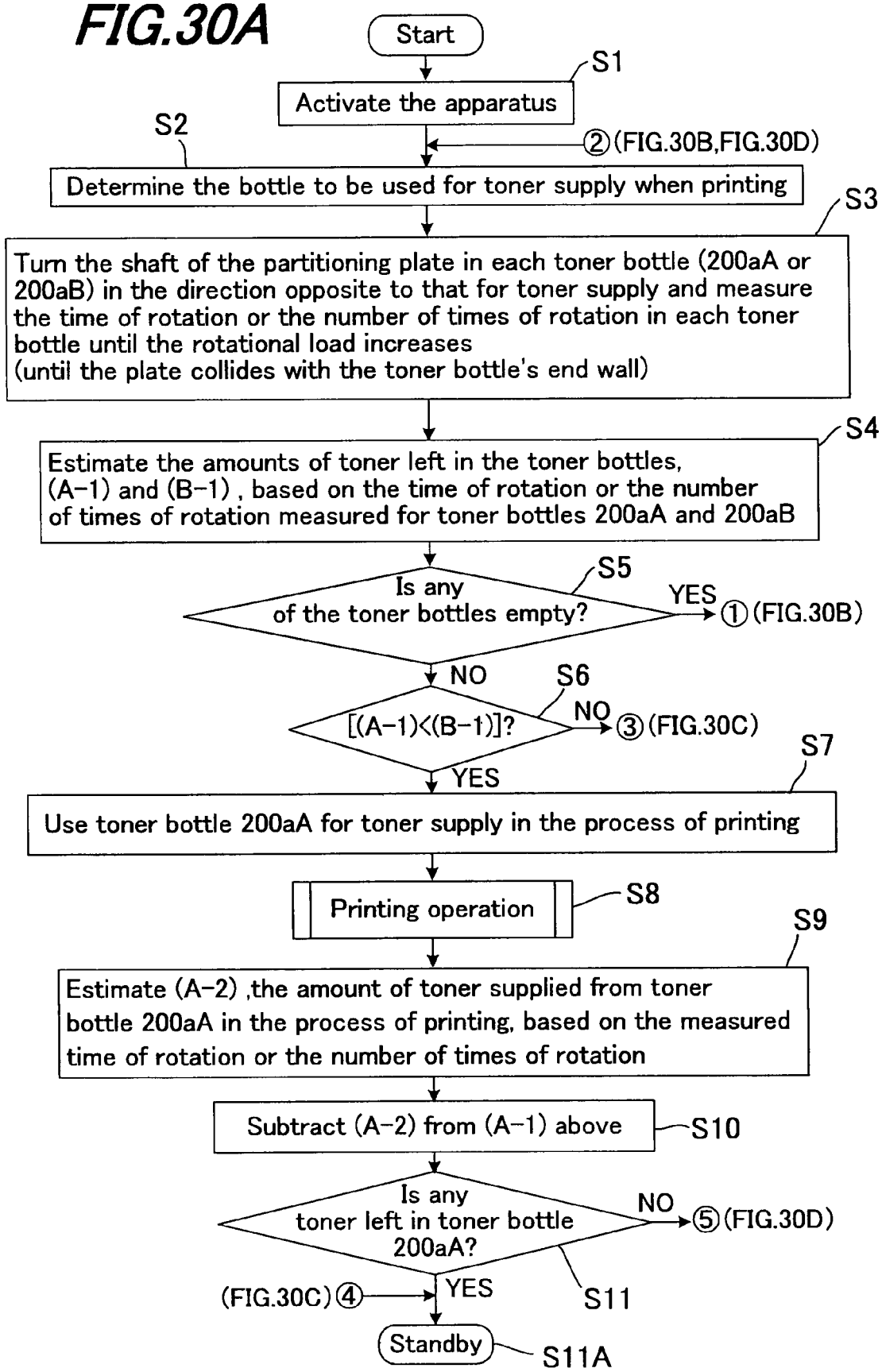
FIGS. 30A to 30D are flowcharts showing the toner supply operation and function of the image forming apparatus.
Figure 30B:
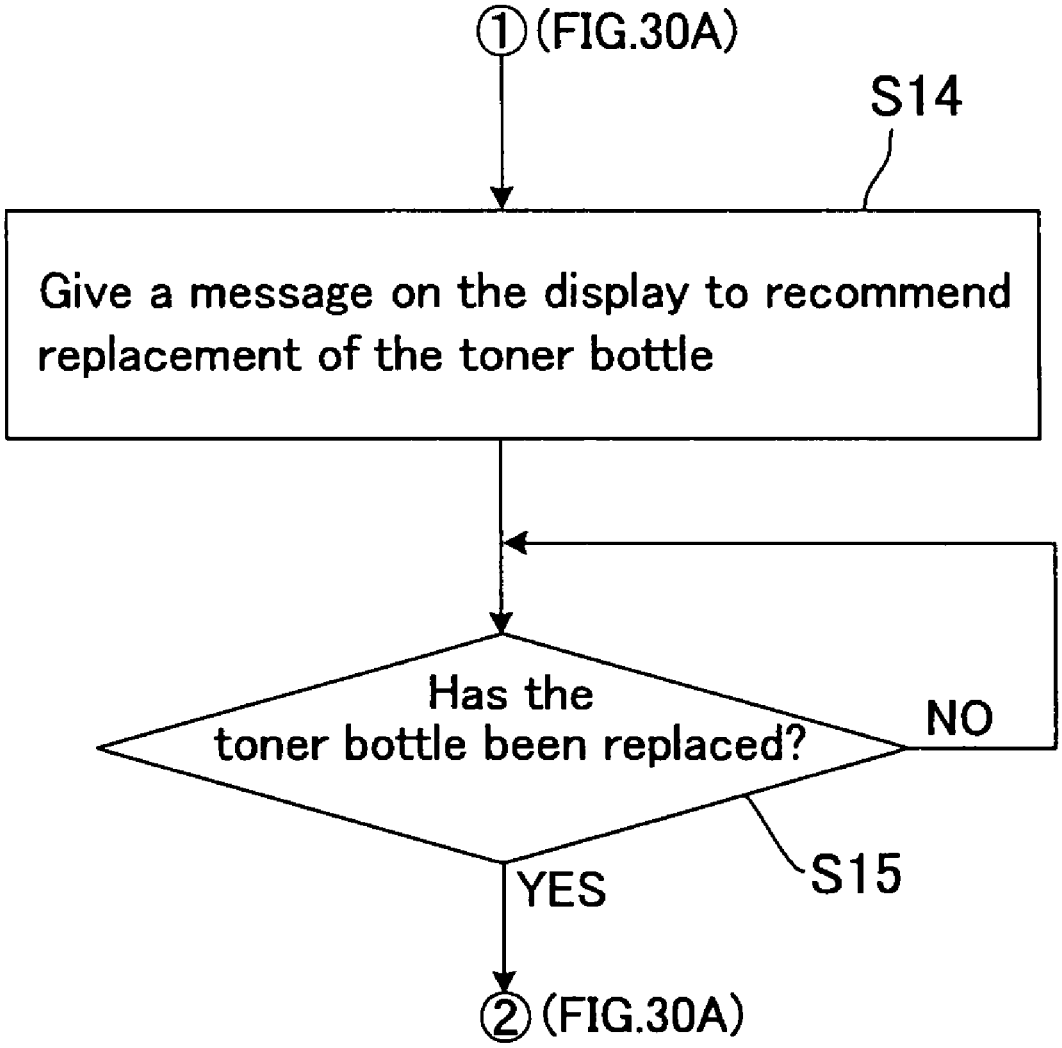
Figure 30C:
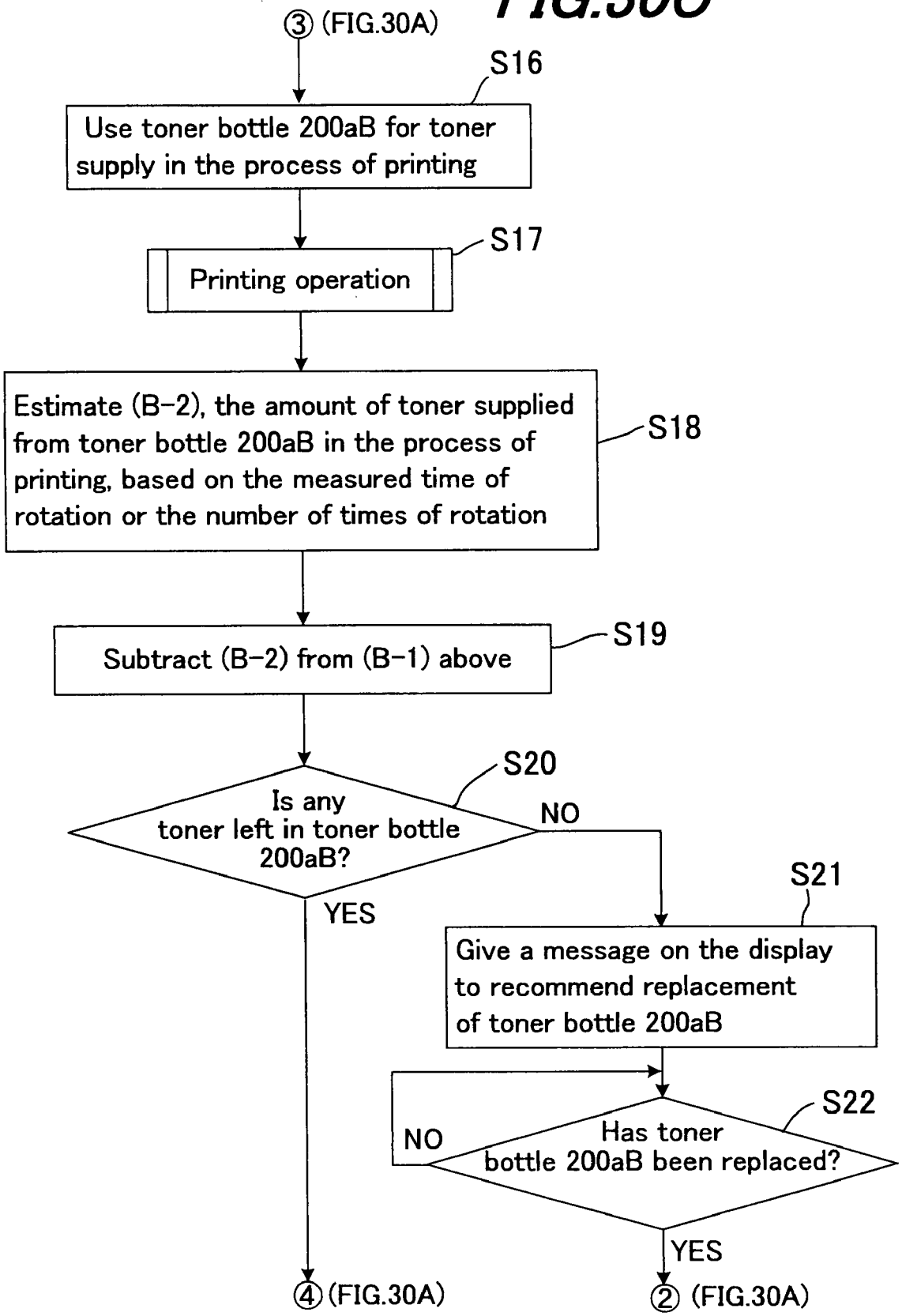
Figure 30D:
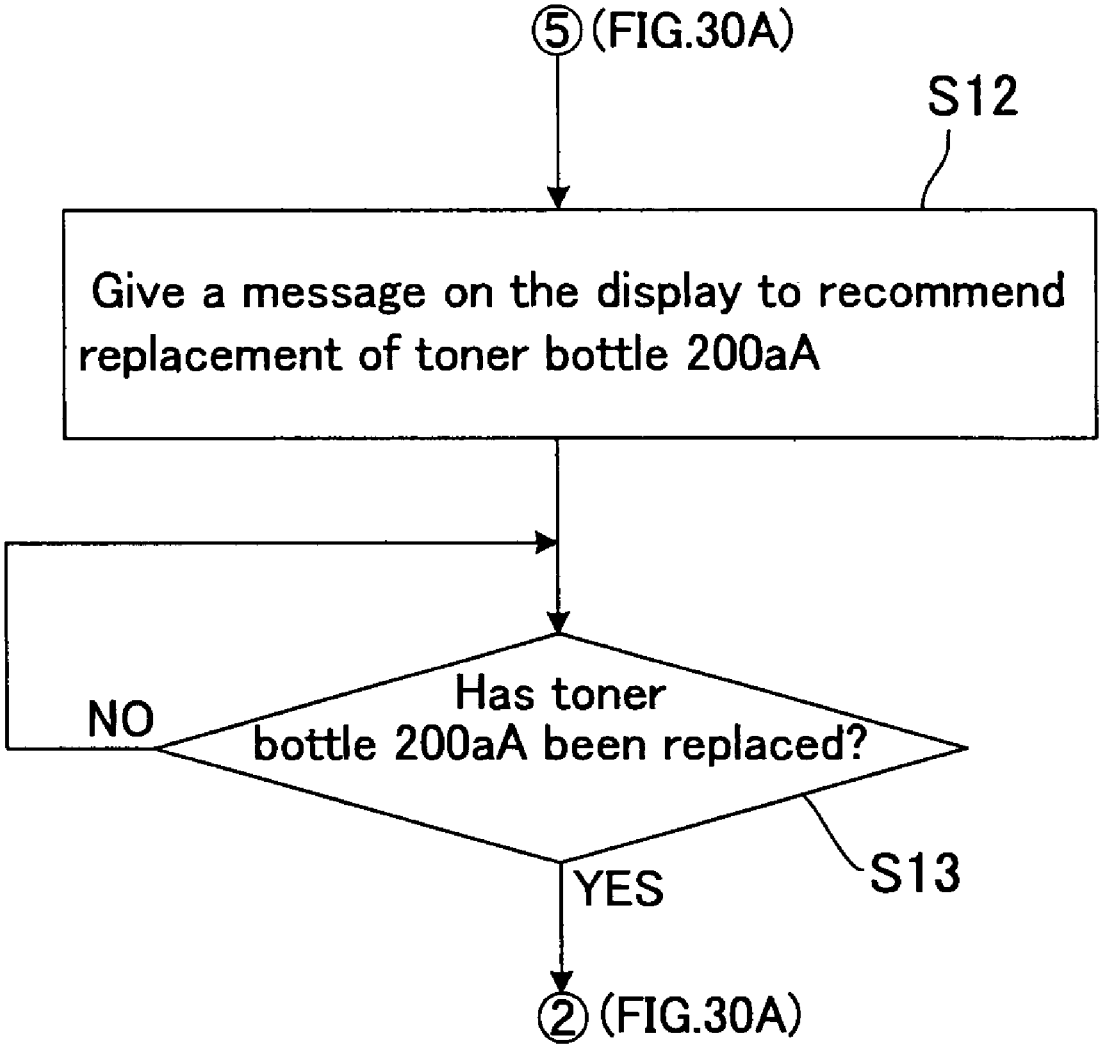

On the other hand, when it is determined that no toner remains in toner bottle 200*a*A, the operation goes to ⑤ of FIG. 30D, and a message for recommending replacement of toner bottle 200*a*A is displayed on the display portion (not shown) of the apparatus (Step S12).

Thereafter, it is determined whether the toner bottle 200*a*A has been replaced (Step S13). When it is determined that the toner bottle 200*a*A has been replaced, the operation goes to ② of FIG. 30A. Then, the above-described steps from Step S2 are executed.

When it is determined that toner bottle 200*a*A is empty at Step S5, the operation goes to ① of FIG. 30B and a message for recommending replacement of toner bottle 200*a*A is displayed on the display portion (not shown) of the apparatus (Step S14).

Thereafter, it is determined whether the toner bottle 200*a*A has been replaced (Step S15). When it is determined that the toner bottle 200*a*A has been replaced, the operation goes to ② of FIG. 30A. Then, the above-described steps after Step S2 are executed.

When, at Step S6, the amount of toner remaining in toner bottle 200*a*A is greater than the amount of toner remaining in toner bottle 200*a*B, the operation goes to ③ of FIG. 30C. At Step S16, toner bottle 200*a*B is determined to be used to supply toner during the process of printing, and a printing operation is implemented (Step S17).

During the process of printing, the amount of toner supplied from toner bottle 200*a*B, referred to as (B-2) is calculated based on the measured time of rotation of feed shaft 214 or the number of times of rotation of the shaft (Step S18).

Then, by subtracting (B-2), the amount of supplied toner from (B-1), the amount of toner remaining in toner bottle 200*a*B (Step S19), whether there is any toner left in toner bottle 200*a*B is determined (Step S20).

At Step S20, it is determined that there is remaining toner therein, the operation goes to ④ of FIG. 30A and enters the standby mode S11A.

On the other hand, when it is determined that no toner remains in toner bottle 200*a*B, a message for recommending replacement of toner bottle 200*a*B is displayed on the display portion (not shown) of the apparatus (Step S21).

Thereafter, it is determined whether the toner bottle 200*a*B has been replaced (Step S22). When it is determined that the toner bottle 200*a*B has been replaced, the operation goes to ② of FIG. 30A. Then, the above-described steps after Step S2 are executed.

Thus, supply of toner to developing unit 23 by toner supply device 100 is performed.

According to the present embodiment thus configured, in toner supply device 100 having a plurality of toner bottles 200*a*A and 200*a*B mounted therein, the amounts of toner remaining in toner bottles 200*a*A and 200*a*B are detected and compared, so as to use one having a lower amount of remaining toner first. Accordingly, since the toner bottle having a greater amount of toner remaining therein can be used second, if the first bottle has run out of toner it is possible to secure a longer duration for replacement of the empty toner bottle, hence providing a plenty of time for preparation of the toner bottle for replacement.

Though the present embodiment is configured so that the toner bottle 200 of a lower amount of remaining toner is selected first, the embodiments are not limited to the condition on which toner bottle is selected. For example, the toner bottle of a greater amount of remaining toner may be used first. That is, bottle selection can be performed in any manner depending on the way the user replaces the toner bottles.

Further, since, in the present embodiment, the position of partitioning plate 213 that moves in accordance with the amount of toner remaining in toner bottle 200 is detected to estimate the amount of remaining toner, it is possible to correctly estimate the amount of remaining toner with a simple structure.

Also, detection of the amount of remaining toner is not limited to the manner described in the above embodiment. For example, detection of the amount of remaining toner may be carried out by estimating the amount of remaining toner based on the number of printout images, the hours of operation or the like. That is, the embodiments can be developed into any form as long as the function of a remaining toner quantity detecting means can be obtained.

In the present embodiment, micro switch 211*a* for detecting the empty state of remaining toner is also provided, it is possible to reliably detect toner empty of the bottle.

Though the present embodiment has been described taking an example in which toner supply device 100 using toner bottle 200 is applied to the image forming apparatus 1 shown in FIG. 1, the embodiments are not limited to the above and can be applied to any kinds of image forming apparatuses as long as they includes an equivalent toner supply device and a developing unit. For example, the invention may be applied to a copier 101 shown in FIG. 31.

Figure 31:
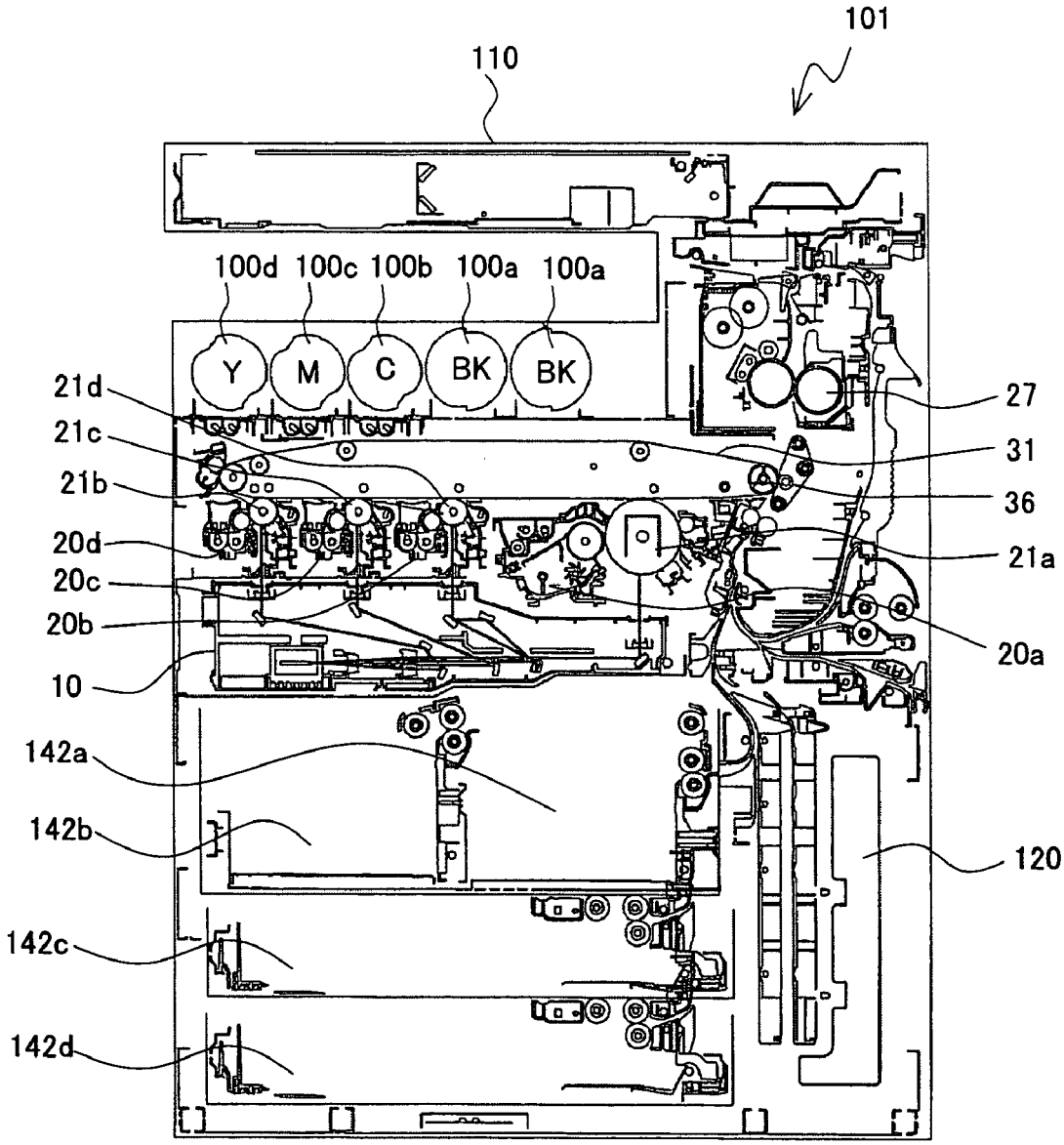
FIG. 31 is an illustrative view showing an overall configuration of a copier according to another embodiment of the present invention.

As shown in FIG. 31, copier 101 includes an image reader (scanner) 110 disposed above an image forming portion 108 using toner bottle 200 and having almost the same configuration as that of image forming apparatus 1 according to the embodiment described above, and first, second, third and fourth paper feed cassettes 142*a*, 142*b*, 142*c* and 142*d* disposed under image forming portion 108 for supporting multiple kinds of paper, to thereby facilitate a variety of and a large amount of automatic printing.

In the drawing, a reference numeral 120 designates a waste toner box for collecting waste toner.

Here, in copier 101, the same components as those in image forming apparatus 1 of the aforementioned embodiment will be allotted with the same reference numerals and description is omitted.

Further, the embodiments of the present invention can be developed into any form of other kinds of image forming apparatuses etc., not limited to the image forming apparatus and copier having the above configurations, as long as it is an image forming apparatus needing a supply of developer (toner).

As has been described above, the present invention should not be limited to the above embodiment and example and various changes can be made within the range specified in the scope of claims. That is, any embodied mode obtained by combination of technical means modified as appropriate without departing from the spirit and scope of the present invention should be included in the technical art of the present invention.

What is claimed is:

1. A toner supply device, comprising:

a plurality of toner containers filled with toner;

a toner feed device having the plurality of toner containers mounted therein and arranged to feed the toner discharged from the toner containers to a developing unit, wherein the toner supply device is controlled so as to supply the toner to the developing unit in accordance with an amount of toner consumed in the developing unit for printing;

a remaining toner quantity detector arranged to detect an amount of toner left in a toner storing portion filled with the toner for each toner container; and a controller arranged to control an operation of the toner supply device, wherein the controller is arranged to select one of the toner containers to be used to supply the toner to the developing unit, in accordance with the amounts of toner left in the plurality of toner containers, detected by the remaining toner quantity detector, wherein the toner container selected is the one that has the least amount of toner remaining therein among the plurality of toner containers.

2. The toner supply device according to claim 1, wherein each toner container comprises:

a partitioning member arranged to separate a container interior into the toner storing portion and an empty space without toner therein; and a partitioning member moving device arranged to move the partitioning member in accordance with the amount of toner left in the toner storing portion so that the toner storing portion will have a suitable volume, wherein the remaining toner quantity detector is arranged to detect a position of the partitioning member when a volume of the toner storing portion has been reduced to a predetermined volume or lower.

3. The toner supply device according to claim 2, wherein the remaining toner quantity detector is arranged to estimate the amount of remaining toner by moving the partitioning member in the empty space.

4. The toner supply device according to claim 3, wherein the remaining toner quantity detector is arranged to estimate the amount of remaining toner based on an amount of time taken for the partitioning member to move in the empty space.

5. The toner supply device according to claim 2, wherein the remaining toner quantity detector is arranged to stop the detection of the amount of remaining toner in response to an increase in a driving load of the partitioning member moving device when the partitioning member has reached a predetermined position in the empty space.

6. The toner supply device according to claim 5, wherein the remaining toner quantity detector is arranged to estimate the amount of remaining toner based on an amount of time taken for the partitioning member to move in the empty space.

7. The toner supply device according to claim 1, wherein the toner container includes a toner information manager with toner information recorded therein, the toner information manager being arranged to perform bi-directional communications with the controller, and the amounts of toner remaining in the plurality of toner containers, detected by the remaining toner quantity detector are stored in both the toner information manager and the controller.

8. The toner supply device according to claim 1, wherein the remaining toner quantity detector is arranged to detect the amount of remaining toner when the toner supply device is switched from a deactivated state to an activated state.

9. The toner supply device according to claim 1, wherein the remaining toner quantity detector is arranged to detect the amount of remaining toner before a printing operation by the developing unit is started.

10. An image forming apparatus which includes a toner supply device, wherein the toner supply device comprises:

a plurality of toner containers filled with toner; and a toner feed device having the plurality of toner containers mounted therein and arranged to feed the toner discharged from the toner containers to a developing unit, wherein the toner supply device is controlled so as to supply the toner to the developing unit in accordance with an amount of toner consumed in the developing unit for printing, wherein the toner supply device further includes:

a remaining toner quantity detector arranged to detect an amount of toner left in a toner storing portion filled with the toner for each toner container; and a controller arranged to control an operation of the toner supply device, wherein the controller is arranged to select one of the toner containers to be used to supply the toner to the developing unit, in accordance with the amounts of toner left in the plurality of toner containers, detected by the remaining toner quantity detector, wherein the toner container selected is the one that has the least amount of toner remaining therein among the plurality of toner containers.

11. The image forming apparatus according to claim 10, wherein each toner container comprises:

a partitioning member arranged to separate a container interior into the toner storing portion and an empty space without toner therein; and a partitioning member moving device arranged to move the partitioning member in accordance with the amount of toner left in the toner storing portion so that the toner storing portion will have a suitable volume, wherein the remaining toner quantity detector is arranged to detect a position of the partitioning member when a volume of the toner storing portion has been reduced to a predetermined volume or lower.

12. The image forming apparatus according to claim 11, wherein the remaining toner quantity detector is arranged to estimate the amount of remaining toner by moving the partitioning member in the empty space.

13. The image forming apparatus according to claim 12, wherein the remaining toner quantity detector is arranged to estimate the amount of remaining toner based on an amount of time taken for the partitioning member to move in the empty space.

14. The image forming apparatus according to claim 11, wherein the remaining toner quantity detector is arranged to stop the detection of the amount of remaining toner in response to an increase in a driving load of the partitioning member moving device when the partitioning member has reached a predetermined position in the empty space.

15. The image forming apparatus according to claim 14, wherein the remaining toner quantity detector is arranged to estimate the amount of remaining toner based on an amount of time taken for the partitioning member to move in the empty space.

16. The image forming apparatus according to claim 10, wherein the toner container includes a toner information manager with toner information recorded therein, the toner information manager being arranged to perform bi-directional communications with the controller, and the amounts of toner remaining in the plurality of toner containers, detected by the remaining toner quantity detector are stored in both the toner information manager and the controller.

17. The image forming apparatus according to claim 10, wherein the remaining toner quantity detector is arranged to detect the amount of remaining toner when the toner supply device is switched from a deactivated state to an activated state.

18. The image forming apparatus according to claim 10, wherein the remaining toner quantity detector is arranged to detect the amount of remaining toner before a printing operation by the developing unit is started.

19. A toner supplying method for use in an image forming apparatus which includes a toner supply device comprising: a plurality of toner containers filled with toner; a toner feed device having the plurality of toner containers mounted therein and feeding the toner discharged from the toner containers to a developing unit, wherein the toner supply device is controlled so as to supply toner to the developing unit in accordance with an amount of toner consumed in the developing unit for printing, the toner supplying method comprising:

detecting an amount of toner left in a toner storing portion filled with the toner for each toner container; and selecting one of the toner containers to be used to supply the toner to the developing unit, in accordance with the detected amounts of toner left in the plurality of toner containers, wherein the step of selecting one of the toner containers comprises selecting the toner container that has the least amount of toner remaining therein among the plurality of toner containers.

20. The toner supplying method according to claim 19, wherein the toner container comprises: a partitioning member which separates the container interior into the toner storing portion and an empty space without toner therein; and a partitioning member moving device which moves the partitioning member in accordance with the amount of toner left in the toner storing portion so that the toner storing portion will have a suitable volume, the toner supplying method further comprising detecting a position of the partitioning member when a volume of the toner storing portion has been reduced to a predetermined volume or lower.

21. The toner supplying method according to claim 20, wherein the remaining toner quantity detecting step includes moving the partitioning member in the empty space.

22. The toner supplying method according to claim 21, wherein the remaining toner quantity detecting step includes detecting an amount of time taken for the partitioning member to move in the empty space.

23. The toner supplying method according to claim 20, wherein the remaining toner quantity detecting step includes stopping the detection of the amount of remaining toner in response to an increase in a driving load of the partitioning member moving device when the partitioning member has reached a predetermined position in the empty space.

24. The toner supplying method according to claim 23, wherein the remaining toner quantity detecting step includes detecting an amount of time taken for the partitioning member to move in the empty space.

25. The toner supplying method according to claim 19, further comprising storing the detected amounts of toner remaining in the plurality of toner containers, into a controller arranged to control an operation of the toner supply device and a toner information manager with toner information recorded therein, provided for each toner container.

26. The toner supplying method according to claim 19, wherein the remaining toner quantity detecting step is performed when the toner supply device is switched from a deactivated state to an activated state.

27. The toner supplying method according to claim 19, wherein the remaining toner quantity detecting step is performed before a printing operation by the developing unit is started.

* * * * *